US006220753B1

(12) United States Patent
Metzger

(10) Patent No.: US 6,220,753 B1
(45) Date of Patent: Apr. 24, 2001

(54) PLASTIC LINER BAG WITH MOUTH RETAINING MEANS

(76) Inventor: Michael A. Metzger, 2013 Queensguard Rd., Silver Spring, MD (US) 20906-2032

( * ) Notice: Subject to any disclaimer, the term of this patent is extended or adjusted under 35 U.S.C. 154(b) by 0 days.

(21) Appl. No.: 09/366,679

(22) Filed: Aug. 4, 1999

(51) Int. Cl.[7] ..... B65D 30/10
(52) U.S. Cl. ..... 383/33; 383/107; 220/495.11
(58) Field of Search ..... 383/8, 33, 35, 383/77, 903, 107; 220/495.11

(56) References Cited

U.S. PATENT DOCUMENTS

| | | | | |
|---|---|---|---|---|
| 3,217,971 | * | 11/1965 | Shvetz | 383/77 X |
| 3,372,857 | * | 3/1968 | Brayla | 383/903 X |
| 3,485,437 | | 12/1969 | Gruentzel . | |
| 3,774,838 | * | 11/1973 | Christie | 383/77 |
| 4,509,570 | | 4/1985 | Eby et al. . | |
| 4,558,801 | * | 12/1985 | Vilutis | 220/495.11 X |
| 4,611,350 | | 9/1986 | Kaczerwaski . | |
| 4,747,701 | | 5/1988 | Perkins . | |
| 4,859,082 | * | 8/1989 | Llorens et al. | 383/77 X |
| 4,919,546 | | 4/1990 | Imazeki . | |
| 4,953,704 | | 9/1990 | Cortese . | |
| 5,133,607 | * | 7/1992 | Bonke | 383/33 X |
| 5,205,650 | | 4/1993 | Rasmussen . | |
| 5,492,240 | * | 2/1996 | Vilutis | 220/62.11 |
| 5,980,109 | * | 11/1999 | Wan | 383/77 |
| 6,029,844 | * | 2/2000 | Brady | 220/495.11 X |

FOREIGN PATENT DOCUMENTS

| | | | | |
|---|---|---|---|---|
| 1496589 | * | 9/1967 | (FR) | 383/8 |
| 111677 | * | 4/1989 | (JP) | 383/8 |
| 7500147 | * | 7/1976 | (NL) | 383/907 |

* cited by examiner

*Primary Examiner*—Jes F. Pascua
(74) *Attorney, Agent, or Firm*—Richard L. Huff

(57) ABSTRACT

A pleated neckdown bag for lining a receptacle is disclosed wherein the bag is made of a flexible plastic film. The disclosed bag has one or more pleat portions (18) fixed at points around the mouth portion (26) of the bag to reduce the circumference of the mouth portion relative to the circumference of the body portion (14). The reduced circumference mouth portion of the neckdown bag can be fitted over a supporting receptacle. The top portion (12) of the bag is thereby more securely held to the support, and the mouth portion is more securely held in an open state, since the narrowed mouth portion of the bag can better engage a support such as the rim of a waste bin. Bag embodiments having flat and flat rectangular constructions, convenient for manufacture, storage, shipping, and dispensing, are also disclosed. Also disclosed is a tabbed neckdown bag embodiment with a tab (52) modifying means to advantageously modify stress and strain at and near the conjunction of a seam and mouth portion of a neckdown bag. The tab is intended to reduce or eliminate the possibility of tearing of the bag at or near a seam in the neighborhood of the tab. The tab projects from a tab base (58), defined between first (54) and second (56) reentrant arcuate portions of a mouth edge (36), and a top seam portion (20) of the bag extends across the tab base and into the tab. Also disclosed is a tab embodiment, usable in a pleated neckdown bag having a flat construction, where inclusion of the tab does not limit certain advantages pertaining to a flat bag construction.

22 Claims, 13 Drawing Sheets

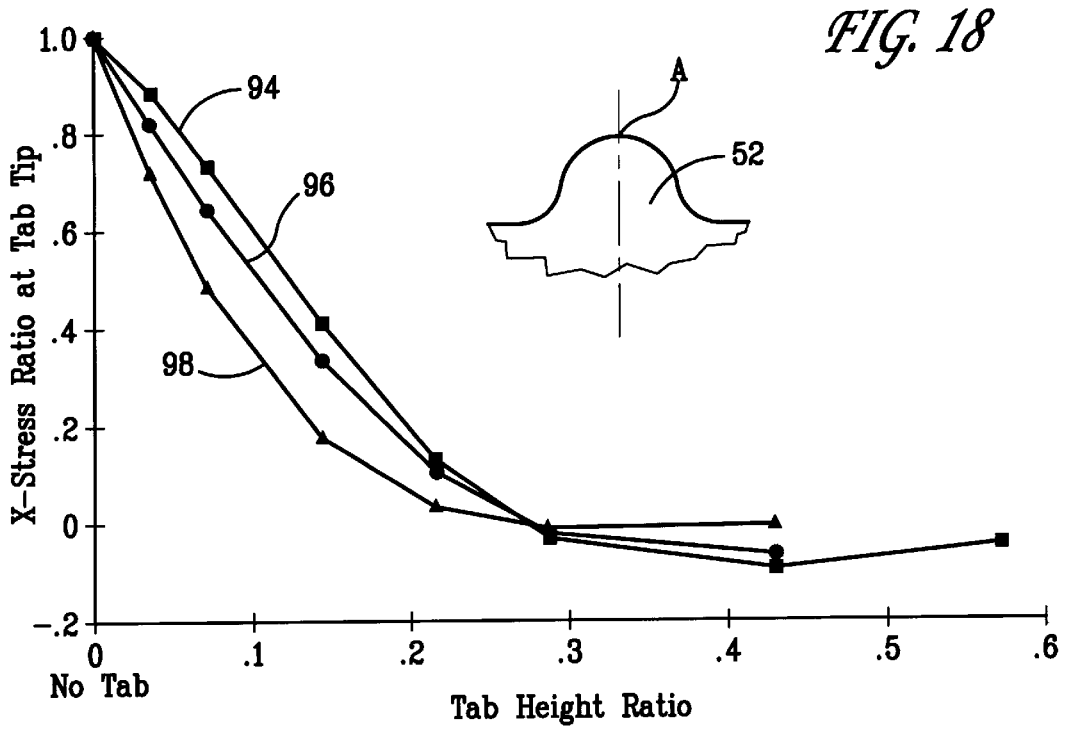
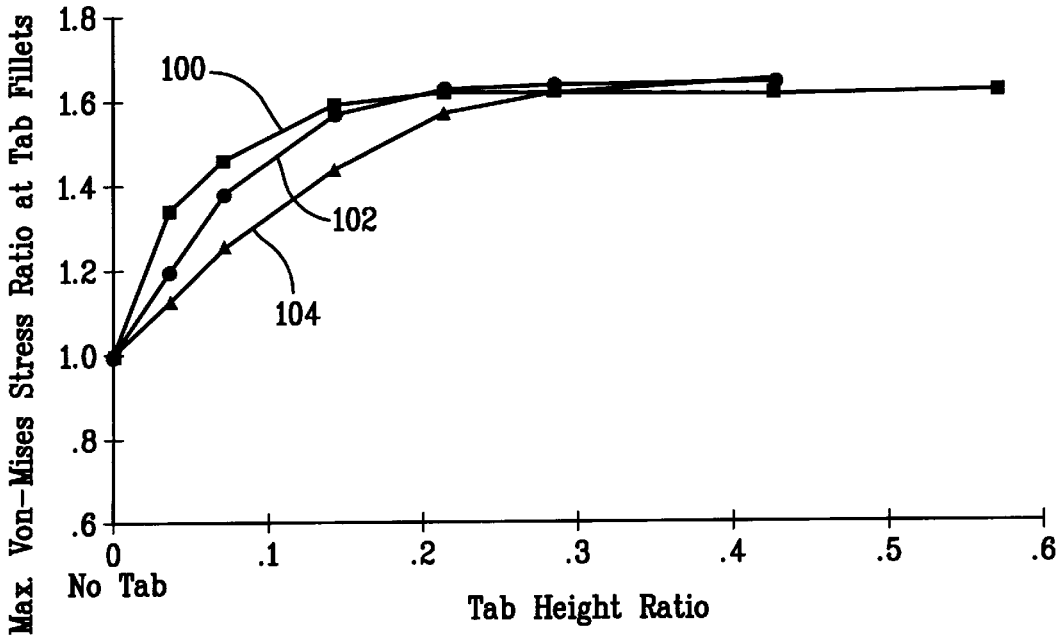
FIG. 19

PLASTIC LINER BAG WITH MOUTH RETAINING MEANS

CROSS-REFERENCE TO RELATED APPLICATIONS

Not applicable.

BACKGROUND

1. Field of the Invention

The invention relates to generally tubular bags, or liners, made of flexible plastic film and used to line a rigid or semi-rigid receptacle such as a waste bin or other collection receptacle. More particularly, the invention relates to a bag having one or more pleats fixed at points around the mouth portion of the bag to reduce the circumference of the mouth of the bag relative to that of the body portion of the bag. When the bag is placed into a supporting receptacle, such as a waste or recycling bin for example, the reduced mouth portion of the pleated bag may be fitted onto the rim of the receptacle and the top portion of the bag will then more securely engage with the receptacle. The bag is thereby more securely held to the support and the mouth portion of the bag is more securely held in an open state. The invention further relates, in certain embodiments thereof, to a reduced mouth pleated bag which is configured to have one or more stress and strain modifying tabs positioned around the mouth portion of the bag. Each tab is intended to reduce the possibility of tearing of the bag at and near the conjunction of a seam and mouth portion of the bag during installation and service of the bag.

2. Description of Prior Art

A bag used as a liner is typically supported by a rigid or semi-rigid structure such as a waste bin or other collection receptacle. When in service, it is usually convenient that the mouth portion of the bag stay open in order to allow the articles to be passed conveniently and unhindered into or out of the bag. Owing to the flexible, pliant nature of a plastic film, a plastic bag is generally not self supporting, nor is the mouth portion of a bag able to reliably remain in an open state on its own. Therefore, it is common to both support the bag, and at the same time keep the mouth portion of the bag open, by folding the top portion of the bag over the rim of a corresponding mouth or opening in the supporting structure. Unfortunately, this method of supporting the bag and bag mouth is often attended with a tendency for the top portion of the bag to slide or fall off, or otherwise disengage from, the supporting structure. When the top portion of a bag slips from its support in such manner, the bag may then cease to accomplish one or more of the functions for which it was intended.

1. NECKDOWN BAGS

The present invention relates to a category of bag or liner having retaining means which rely primarily on the circumference of the mouth portion of the bag being less than that of the body of the bag. Hereinafter, bags or liners utilizing this retaining means will be referred to as "neckdown" bags. For a bag used as a liner, it is usually convenient and economical that the bag have a body that is larger in circumference than that of a supporting structure or receptacle into which the bag is placed. However, in this case the top portion of the bag, when folded over a rim or lip of the supporting structure, may yield a loose fit at best, and therefore offer little additional support for the bag. A reduced circumference mouth portion of a neckdown bag greatly aids in supporting the bag on all manner of supporting structures, especially if the reduced circumference portion is approximately equal or less than that of the supporting structure. In this case the reduced mouth portion can more readily engage the support and thereby provide additional support for the bag whilst the larger circumference body portion of the bag can remain adequately sized to fit the receptacle.

Some neckdown bags or liners utilize one or more elastic members, or bands, permanently engaged with, or bonded to the bag, and sized so that the elastic member will elastically stretch around and grip a supporting structure. Such constructions are disclosed for example in Eby et al (U.S. Pat. No. 4,509,570), Cortese (U.S. Pat. No. 4,953,704), and Perkins (U.S. Pat. No. 4,747,701). Perkins in U.S. Pat. No. 4,747,701 asserts that in some "liner bags", the slight elasticity of the plastic itself will aid in holding the bag in place, that some bags will stretch to a small extent so that they are held tightly when folded over the rim of a receptacle. It is further asserted that the elasticity of the typical liner bag is relatively low and the bags will often tear when pulled too hard. These perceived drawbacks of a typical liner bag film force the design of the bag disclosed to require an "elastic band" or head member to be permanently attached to the bag body. Typical materials disclosed for the elastic band are "elastomers" such as "latex" (a rubber elastomer) and "DUREFLEX tm PT6100S" (of Deerfield Urethane, Inc.) an aromatic polyether polyurethane film which is a thermoplastic elastomer. An elastomer film exhibits a rubber-like elastic deformation response, that is, it can greatly elongate upon the application of a relatively weak stretching force, and upon removal of this stretching force, the film quickly recovers substantially its original shape and size, mimicking the familiar action of a rubber band being stretched and then released. The elastic band is required to be bonded to a relatively inelastic bag body in order to achieve a functional self gripping neckdown liner. As the attached elastic band is required to perform the self retaining action, the elastic band, not the bag body, is made to have the neck down feature. It is apparent that such a bag design, while functional, is complicated by having the liner made of two distinct members, the relatively stiff bag body, and the elastic band or head member. The two members are required to be intimately attached along a common edge, leading to a necessary complexity in the bag structure and in the manufacture of such a liner bag.

It is known that a bag having a reduced size mouth relative to the body of the bag can be constructed by joining together portions along the top of the bag to form a pleated neckdown bag having reduced circumference mouth portion relative that of the bag body. Imazeki et al (U.S. Pat. No. 4,919,546) discloses such a method to obtain a neckdown bag, as does Perkins in U.S. Pat. No. 4,747,701 already cited above. Disadvantages are apparent in Imazeki et al in that the bag supporting function relies strictly on the principle that the bag body material is "non-elastic", or inelastic, and thereby can bear no stretching either on installation of the bag to its support, or while the bag is being supported. The "non-elastic" limitation requires the use of a specially engineered hoop-like support to be designed and then installed in a specified way so as to avoid any stretching of the bag, thereby affording a purely kinematic constraint to secure the liner to the support. The need for the hoop support greatly limits the types of support receptacles that can be used with the bag and increases the complexity and cost of such a system.

Kaczerwaski (U.S. Pat. No. 4,611,350) discloses a closed bottom "sack" of thermoplastic film comprising at least one cold stretched, circumferential band portion of diameter that is reduced from the original diameter of the sack. The band of reduced diameter is obtained by cold stretching the film so as to procure, through a permanent material "necking-down" phenomenon, a circumferential band of reduced diameter in the region adjacent to the bag mouth opening (the "necking-down" term used to describe the phenomenon disclosed in Kaczerwaski is a term of art in the science of materials and is not to be confused with the similar "neck-down" term used herein to refer to a particular construction of a bag). The reduced band region of the bag can be positioned relative to the bag mouth so as to accommodate a more secure, gripping overfold region when the bag is employed as a waste container liner. The method disclosed is limited to materials that will neck-down when cold stretched. Another drawback to this method is that there is a limit to the degree of reduction of bag diameter that can be achieved with the method disclosed and the method requires highly specialized equipment to introduce the necking-down phenomena to the bag.

It is generally known that a self securing neckdown bag is obtainable by the common practice of "tying off" corners of a bag mouth using one or more overhand knots. This action creates a reduced or neckdown mouth opening thus allowing the bag mouth to be securely fitted over a supporting structure or receptacle. The knot method of forming a neckdown bag does not lend itself to mass production or convenient bulk packaging, and can become cumbersome for large liners or liners having heavy walls. Moreover, this method can be difficult or impossible to implement for someone unable to effect the knot due to lack of dexterity possibly due to physical impairment such as arthritis or a Repetitive Stress Injury. Further, one involved in the cleaning or janitorial service industry using this method will be forced to tie knots many times a day possibly leading eventually to a Repetitive Stress Injury as a result of the excessive repetition of tying many knots over long periods. The tying off method results in one or more unsightly "pigtails", left on the outer rim of the support by the existence of the knot or knots. Finally, the use of a knot in a neckdown bag may require an excess of film material to be used in order to make up the knot, and thereby result in a liner having an effectively shorter length which may then not fit the support or bin, or may require a longer liner and therefore a wastage of bag film material.

2. TEARING OF PLASTIC FILM BAGS

When a pleated neckdown bag is initially fitted onto a supporting receptacle, the bag film at and near the mouth portion of the bag is susceptible to tearing, especially at any seam restricting the mouth portion. Because the plastic film at and near the mouth portion of the neckdown bag continues supporting the bag and bag mouth during the service life of the bag, the film is apt to tear when the bag is in service as well. The propensity for tearing of the bag film is thought to be most acute about the mouth portion, particularly at a seam intersecting the mouth. This is because the forces applied to the bag mouth on installation, and the possibility of somewhat lessened film strength in or near a seam, results in a relatively increased possibility of tearing the plastic film at or near this location more so than at other points around the mouth. A tear, once initiated, may then continue to propagate preferentially along the seam and may then impair the neckdown feature and, hence, reduce or eliminate the advantages obtained thereby.

Methods to minimize or eliminate tearing of a bag at or near a seam, or for rendering this tearing harmless, are disclosed. For example R. A. Gruentzel et al (U.S. Pat. No. 3,485,437) discloses a method to render harmless the tearing of a weakened seam, at its terminus at the mouth of a bag, by providing for a second weakened area, either a slit, scored, or thinned region, being located near the first weakened area, but spaced from it. When tensional forces cause the seam at the mouth to tear, the tear is arrested, by the second weakened area, from further propagation along the seam, and the tear is redirected away from the seam into presumably stronger regions of the bag, where the tear is presumably arrested or minimized. The method of providing a second weakened area, as in U.S. Pat. No. 3,485,437, while it can control a tear by redirecting it away from the seam, does not necessarily eliminate the occurrence of a tear. Such a tear, even if it is redirected away from the seam, could still be detrimental to the retaining function of a neckdown bag.

Rasmussen (U.S. Pat. No. 5,202,650) discloses placing a band of embossed indentations adjacent a seam "susceptible to rupture when stressed" so that the band, being "more rubberlike" than the unmodified material, may increase the resistance of the seam to rupture under stress. The method of providing a band of indentations certainly might be useful for preventing tearing of a seam in a neckdown bag, however such a method requires additional specialized film embossing machinery perhaps not normally required in the manufacture of plastic film bags or liners.

SUMMARY OF THE INVENTION WITH OBJECTS AND ADVANTAGES

In accordance with the present invention a pleated neckdown bag made of a flexible plastic film, and for lining a receptacle, is disclosed wherein the neckdown feature of the bag is constructed by pleating the bag inwardly at one or more points around the mouth portion. Two side, or flank, portions of a given pleat portion of the bag are joined together along the top portion of the bag. The joining means interconnecting the flank of a pleat will generally form a seam, or seam portion, partway across the top portion of the bag, the seam perhaps comprising a heat or fused seal, adhesive bond, or a joinder. The inwardmost portion or end of such a seam portion, that is the end nearest or adjacent the mouth of the bag, effectively restricts the mouth portion so that the circumference of the mouth portion is substantially less than that of the body portion of the bag. The neckdown bag can be expanded and the reduced circumference mouth portion fitted over a supporting receptacle. The top portion of the bag is thereby more securely held to the support, and the mouth portion is more securely held in an open state, since the narrowed mouth portion of the bag can better engage a support such as the rim of a waste or other collection receptacle. Bag embodiments are disclosed having flat constructions and flat rectangular constructions, both convenient for manufacture, packaging, storage, and dispensing.

Certain disclosed embodiments of the present invention provide for a "tab", that is, a "finlike" extension of a portion of a bag adjacent an edge defining a mouth edge of the bag. Each tab is arranged about the mouth portion of the bag so that the tab projects from a tab base, defined between first and second reentrant arcuate portions of a mouth edge, and a top seam portion of the bag extends across the tab base and into the tab. Such a tab will advantageously modify the stress and strain in the bag at and near the tab so as to reduce the possibility of tearing the seam or mouth portion of the bag in the neighborhood of the tab. A particular tab embodiment is also disclosed that offers teat protection while allowing the bag to retain a typical "flat" construction.

Objects and Advantages

It is the object of the present invention to provide a pleated neckdown bag for lining a receptacle, wherein the bag is made of a flexible plastic film. The narrowed, or neckdown, mouth portion of such a bag may be fitted onto the rim of a rigid or semi-rigid supporting receptacle, such as a waste bin, so the top portion of the bag more reliably engages with the supporting receptacle, and the mouth portion of the bag is more securely held in a generally open state. In certain embodiments, the invention has the further object to construct and employ a pleated neckdown bag made of a typical low cost plastic bag film, such as a polyethylene based film. It is the further object, in certain embodiments of the invention, to provide a generally flat pleated bag construction that is relatively straightforward both to manufacture, and to package, especially by automated or semi-automated means, and lends itself to more convenient storage and dispensing. It is the further object of the invention, in certain embodiments thereof, to provide a pleated neckdown bag construction having one or more tabs for advantageously modifying stress and strain at and near the conjunction of a seam and mouth portion of a bag. Each tab is intended to reduce or eliminate the chance of tearing of the bag when in use, at or near the mouth and seam portions, where such tearing might be detrimental to the retaining function of the bag. Still further objects and advantages will become apparent from a consideration of the ensuing description and drawings.

DESCRIPTION OF THE DRAWINGS

FIG. 18 is a graphic representation of the estimated effect of tab height ratio on the x-stress ratio at the tip of tab models having the rectangular, circular, and triangular tab style, and when the tab models were subject to a tensile stress simulating stressing of a tabbed bag in the vicinity of the tab.

FIG. 19 is a graphic representation showing the estimated effect of tab height ratio on the estimated maximum Von Mises stress ratio at the base of the tab fillet regions for the analytic models having a rectangular, circular, and triangular tab style, respectively, and for the case where each tab model was subject to a tensile stress simulating stressing of a tabbed bag in the vicinity of the tab.

REFERENCE NUMERALS USED

Figure 1:
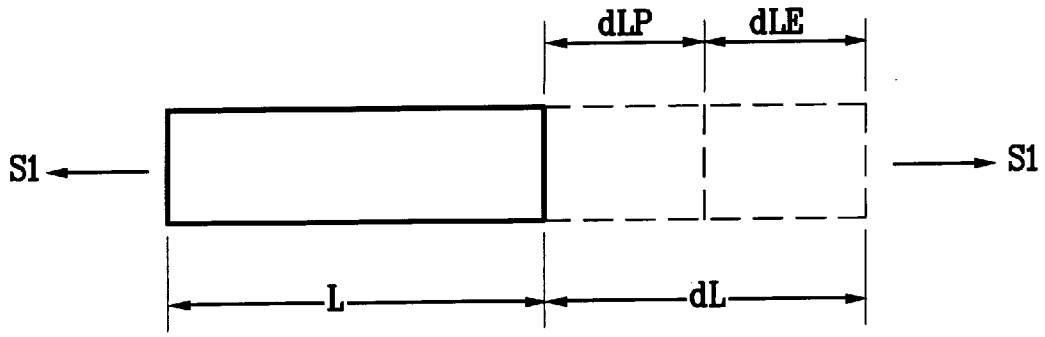
FIG. 1 is a schematic diagram of a uniaxial tensile sample of a flexible plastic film and shows the applied load and key length measurements.

| | |
|---|---|
| 10 | Pleated Neckdown Bag |
| 12 | Top Portion |
| 14 | Body Portion |
| 18 | Pleat Portion |
| 20 | Top Seam Portion |
| 22 | Outwardmost End (of a Top Seam Portion) |
| 24 | Inwardmost End (of a Top Seam Portion) |
| 26 | Mouth Portion |
| 28 | First Flank Portion |
| 30 | Second Flank Portion |

-continued

| REFERENCE NUMERALS USED | |
|---|---|
| 32 | Pleat Edge Portion |
| 34 | Joining Means |
| 36 | Mouth Edge |
| 38 | Supporting Receptacle |
| 40 | First panel portion |
| 44 | Top Edge |
| 46 | Bottom Edge |
| 48 | First Side Edge |
| 50 | Second Side Edge |
| 52 | Tab |
| 54 | First Reentrant Arcuate Portion |
| 56 | Second Reentrant Arcuate Portion |
| 58 | Tab Base |
| 62 | First Mouth Edge Portion |
| 64 | Second Mouth Edge Portion |
| 66 | Recessed Cut |
| 80 | Adjacent Portion of the Bag Film (bag portion modeled adjacent a tab in FEM models) |
| 82 | Tab Line-of-Symmetry, or Tab Centerline in an FEM analytic model |
| 84 | Free Edge of a Tab (tab edge modeled in FEM models) |
| 86 | Side Edges |
| 88 | Curve for x-stress ratio along tab centerline for rectangular, triangular, and circular tab styles, each tab having a tab height ratio of 28.6 percent. |
| 90 | Curve for x-stress ratio along tab centerline for no-tab case. |
| 92 | Lines of Constant First Principal Stress Ratio for a rectangular tab model having a tab height ratio of 28.6 percent. |
| 94 | Curve for X-stress Ratio at Tab Tip vs. Tab Height Ratio for a rectangular tab style. |
| 96 | Curve for X-stress Ratio at Tab Tip vs. Tab Height Ratio for a circular tab style. |
| 98 | Curve for X-stress Ratio at Tab Tip vs. Tab Height Ratio for a triangular tab style. |
| 100 | Curve for Max. Von Mises Stress Ratio at Tab Fillets vs. Tab Height Ratio for a ractangular tab style. |
| 102 | Curve for Max. Von Mises Stress Ratio at Tab Fillets vs. Tab Height Ratio for a circular tab style. |
| 104 | Curve for Max. Von Mises Stress Ratio at Tab Fillets vs. Tab Height Ratio for triangular tab style. |

DETAILED DESCRIPTION OF THE PREFERRED EMBODIMENTS OF THE INVENTION

1. PLASTIC BAG FILMS

While a bag or liner can be made of virtually any plastic film, the plastic film typically used in a bag or liner construction is not an elastomer, but rather is another plastic such as an olefin plastic. This is especially the case for a bag used for lining a waste or recycling receptacle. Perhaps the most common plastics for liner films at present are ethylene plastics, that is, plastics covered by the ASTM D 883-96 definition for "ethylene plastics" (the ASTM D 883-96 definition is as follows: "plastics based on polymers of ethylene or copolymers of ethylene with other monomers, the ethylene being in greatest amount by mass."—Reprinted, with permission, from the Annual Book of ASTM Standards, copyright American Society for Testing and Materials, 100 Bar Harbor Drive, West Conshohocken, Pa., 19428). For example, ethylene plastics for bag films include Low Density Polyethylenes (LDPE), having a density in the range of approximately 0.910 to 0.925 g/cc, Linear Low Density Polyethyenes (LLDPE) having a density in the range of approximately 0.919 to 0.925 g/cc, and High Density Polyethylenes (HDPE) having a density in the range of approximately 0.941 g/cc or greater. Polymer resin blends that include at least one ethylene plastic are also used in bag films.

Presently bag films are typically monolayer film made of a single resin type. The resin type may be a polymer, copolymer, or blend of two or more distinct polymers or copolymers. More recently multi-layer film constructions are being used in some bags. For example "coextruded" films, wherein each layer may have a resin type the same as or different from that of any other layer, are employed nowadays in some bag constructions. Though not typical at present, a bag film can be constructed of a multi-layer film made by laminating two or more plastic films. The gauge of a plastic bag film (that is, the thickness of the base film used to construct the bag) may be in the range from about 0.2 mils to about 4 mils or greater.

In a bag made of a typical plastic bag film, for example a LDPE, LLDPE, or HDPE, the initial stiffness of the bag film generally permits the bag body to contain its cargo without undue distortion or stretching (an LDPE film may have perhaps ten times or more of the initial stiffness of a typical elastomer film). Unlike an elastomer film, which typically stretches elastically to rupture and even after rupture rapidly recovers virtually all the deformation, a typical plastic bag film may exhibit plastic deformations, that is "yielding" or "plasticity", when deformed sufficiently. The "plastic" portion of a deformation is characterized by its ability to remain for indefinite times, even after the external deforming stress or force that caused it is removed, and so long as no external agent is brought in to modify this deformation. Thus, if a plastic film will yield on deforming, it can have a high initial stiffness but still be able to be stretched by hand without undue difficulty. Yet, even when a plastic film is stretched or elongated, it still may retain sufficient "elasticity", that is, the ability to return, contract, or even "snap back", to some degree, toward its original shape or length, whether immediately or over some time period, after removal of the deforming load or stress.

1.1 Example of Deformation of a Plastic Bag Film

By way of example, the response of a polyethylene plastic bag film to tensile deformation is now presented. Samples of a bag film, cut from commercial polyethylene waste liners, were stretched uniaxially to rupture by subjecting the samples to an axial tensile force, S1, at the ends as depicted in FIG. 1 of the drawings. The polyethylene film tested was a 0.85 mil LLDPE film. Results of the tests appear in the Table below along with results for a 6 mil latex rubber elastomer film.

Referring to FIG. 1 of the drawings and the Table below, the "Percent Total Elongation" of the sample at break, ET, is equal to the total elongation dL just prior to rupture, divided by the sample gage length, L, that is ET=(dL/L)(×100). The "Percent Plastic Elongation" of the sample at break, EP, is equal to the unrecovered elongation dLP after rupture, divided by of the sample gage length, L, that is EP=(dLP/L)(×100). The "Percent Elastic Elongation" of the sample at break, EE, is equal to the recovered elongation dLE after rupture, divided by of the sample gage length, L, that is EE=(dLE/L) (×100). The "Pliancy Index", or "Ω", is the percent of total elongation that's plastic, and is equal to the unrecovered elongation dLP, divided by the total elongation of the sample dL, that is, Ω=(dLP/dL) (×100). Finally, the "Resiliency Index", or "α", is the percent of total elongation that's elastic, and is equal to the elongation recovered after rupture, dLE, divided by the total elongation of the sample dL, that is, α=(dLE/dL)(×100). Typical test samples had an initial width of 1.25 inches and a initial gage length typically 10 inches, but in some cases 7.5 or 5 inches.

TABLE

| Sample Description | Test Direction/ No. Tests | Percent Total Elong. at break (ET) | Percent Plastic Elong. at break (EP) | Percent Elastic Elong. at break (EE) | Pliancy Index (Ω) | Resiliency Index (α) |
|---|---|---|---|---|---|---|
| LLDPE Bag Film 0.85 mil | Extrusion Direction/31 | 277–600 | 151–465 | 124–146 | 54–79 | 21–46 |
| | (average) | (421) | (287) | (134) | (66) | (34) |
| LLDPE Bag Film 0.85 mil | Cross Direction/10 | 626–743 | 490–599 | 130–165 | 76–81 | 19–24 |
| | (average) | (677) | (534) | (142) | (79) | (21) |
| Latex Rubber (Natural) 6 mil | NA/12 | 788–850 | 5.0–8.7 | 759–842 | 0.6–1.0 | 99.0–99.4 |
| | (average) | (811) | (6.6) | (805) | (0.8) | (99.2) |

In the Table the "Resiliency Index", α, indicates a measure of the amount of total elongation that was returned, or recovered, after rupture of the sample occurred. The Resiliency Index can be viewed roughly as a measure of the "rubberyness" of the sample, that is, the degree of rubberlike behavior of the sample in its elastic response to stretching. Thus the latex rubber samples tested exhibited a very high Resiliency Index of, on average, 99.2 percent. Conversely, the "Pliancy Index", Ω, in the Table is a measure of the amount of the total deformation that remained after the sample ruptured. The Pliancy Index can be viewed roughly as a measure of the degree of "puttylike" behavior of the sample in its response to stretching, "puttylike" here referring by analogy to the perfectly plastic, or pliant, response of an ideal "putty" material when deformed. The definition of the terms requires that, for a given test sample, $\alpha+\Omega=100$ percent.

The tested LLDPE samples exhibited large total elongations at rupture varying from 277 to 743 percent, i.e. the samples typically stretched to about four to eight times their original length before rupturing. The plastic, or unrecovered, elongations varied widely from 151 to 465 percent (extrusion direction tests) and 490 to 599 percent (cross direction tests). The elastic, or recovered, elongations fell in a narrower range from 124 to 165 percent for all the LLDPE tests, both parallel and perpendicular to the extrusion direction of the film. On average, the LLDPE samples exhibited a 134 percent elastic elongation when tested in the extrusion direction, and a 142 percent elastic elongation in the cross direction. In other words, the typical LLDPE sample endured an elastic deformation of about one and one-third times its original length, all of this elastic deformation being recovered, indicating a substantial elasticity of the LLDPE film samples in this case. As the data indicates, for all the tested LLDPE samples the total elongation at rupture was partly elastic and partly plastic. For example, the tested LLDPE material in the extrusion direction exhibited, on average, a Resiliency Index (i.e. rubberlike response) of 34 percent and a Pliancy Index of 66 percent.

For the particular LLDPE polyethylene bag film samples tested, some not insignificant visco-elastic behavior was observed. For example, typically about 90 percent of the entire elastic, or recovered, elongation was recorded very soon (within about 5 minutes) after sample break. The remaining roughly 10 percent of the total recovered elongation would typically be manifested more slowly over time as the sample continued to contract. For example, typically an additional 6 percent (approximately) recovery occurred gradually over several hours, and the last 4 percent (approximately) of recovery occurred even more gradually over roughly a three or four day period. By contrast, for the typical latex elastomer film sample tested, virtually all (above 99 percent) of the recovered elongation of a test sample occurred within about a minute from rupture.

The deformation characteristics of typical plastic bag films, such as polyethylenes for example, are useful for employing such films in self-retaining pleated neckdown bags for use in lining receptacles. Generally the mouth portion of a pleated neckdown bag may be stretched out more or less to allow fitting it around the supporting lip of a receptacle. This stretching action may involve imposing elastic, or both elastic and plastic, deformations in the bag film material. So long as there is sufficient engagement of the bag mouth with its support, the mouth need not recover all of its original unstretched dimension, or circumference, and any plastic deformation that may occur is not necessarily detrimental to the retaining function of the bag. In addition, the ability of typical plastic bag films to eventually yield on stretching may be convenient to a pleated neckdown bag since it may limit the exertion required to install the bag, in spite of a relatively high initial film stiffness, and may to some extent limit the internal stresses imposed in the plastic film on stretching. Furthermore, the ability of some plastic bag films to yield may afford a bag having a mouth of one size to fit a relatively large range of receptacle sizes. For cases where stretching of a particular plastic bag film must be limited, it is possible to construct the pleated neckdown bag so that the virgin circumference of the bag's mouth portion is such as to conveniently limit any stretching required to install the bag onto a given size receptacle. If sufficient stretching is imposed when installing a pleated neckdown bag made of a plastic film that exhibits some viscoelasticity, engagement of the bag with its support can continue to increase well after initial installation due to the viscoelastic recovery of some portion of the stretching. Finally, while the tested LLDPE film was stressed to rupture, in actual service a pleated neckdown bag may not require its being stretched to, or near to rupture. In some cases even little or no stretching may be required for a pleated neckdown bag to adequately engage with its support so as to prevent or minimize slipping of the bag walls or collapsing of the mouth portion of the bag.

2. GENERAL NECKDOWN BAG EMBODIMENT

Figure 2:
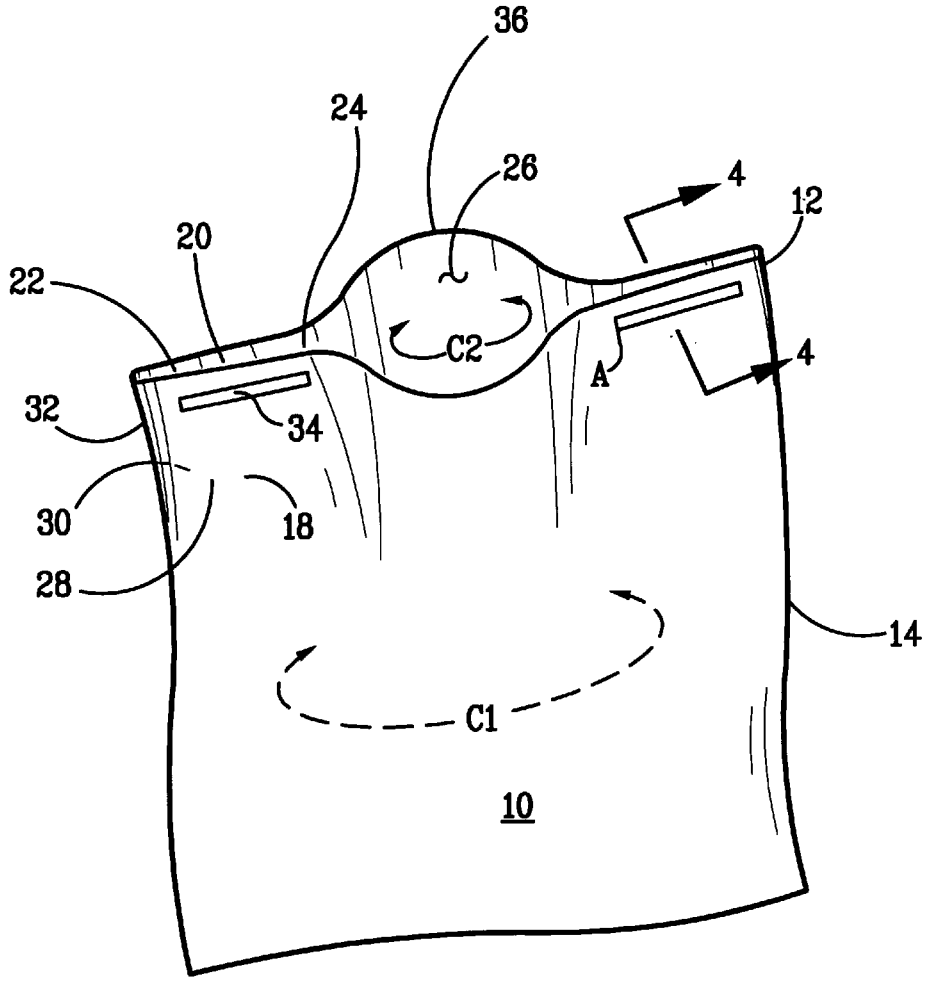
FIG. 2 is a perspective view of one embodiment of a pleated neckdown bag.

Referring to FIG. 2 of the drawings, a preferred embodiment of the present invention is a generally tubular pleated neckdown bag 10 made of a flexible plastic film. More particularly, the bag comprises an open top portion 12, and a hollow body portion 14 having a first inside circumference C1. The first inside circumference C1 is the length of the bag taken circumferentially around and along the interior, or inside, of the substantially unstressed and unstretched bag, and taken in a plane generally perpendicular to the length of the bag, the length direction being oriented generally upwardly and downwardly along the bag. The top portion 12 is disposed adjacent the hollow body portion 14, and there-adjoins about the first inside circumference thereof, the hollow body portion thereby extending generally downwardly from the top portion.

The top portion of the neckdown bag further comprises at least one pleat portion 18 thereof, at least one top seam portion 20 thereof having an outwardmost end 22 thereof and having an inwardmost end 24 thereof, and at least one mouth portion 26 thereof, the mouth portion having a second inside circumference, or inside girth, C2.

The pleat portion lies adjacent the mouth portion and is inwardly pinched, or pleated, toward the mouth portion. The pleat portion thereby comprises a first flank portion 28 and a second flank portion 30 and a pleat edge portion 32. The second flank portion adjoins the first flank portion generally upwardly and downwardly along the pleat edge portion, whereby the pleat edge portion faces generally outwardly away from the mouth portion.

The top seam portion 20 further comprises means 34 for joining, or interconnecting, the first and second flank portions of the pleat portion across at least a portion of the top portion of the neckdown bag. The inwardmost end of the top seam portion is thereby disposed adjacent the mouth portion and the outwardinost end is spaced further outwardly away from the mouth portion than the inwardmost end. The inwardmost end of the top seam portion thereby effectively restricts at least the mouth portion so that the second inside circumference or inside girth, C2, of the mouth portion is substantially less than the first inside circumference, C1, of the body portion. The joining means 34 may comprise a heat or fised seal, adhesive bond, or a joinder.

Figure 3:
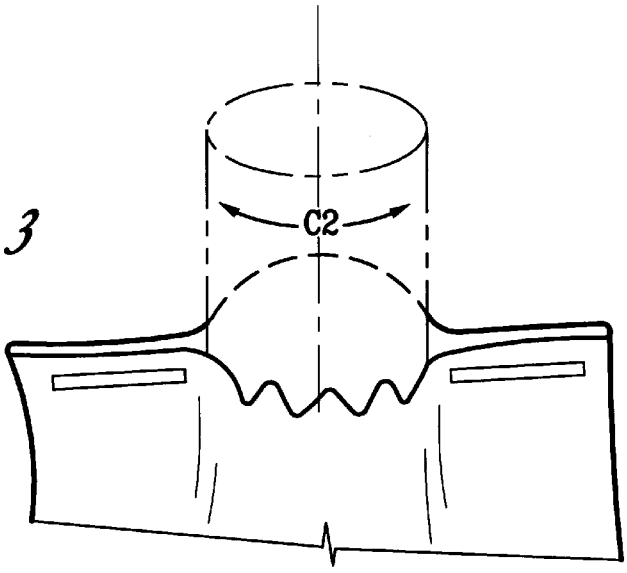
FIG. 3 is a perspective view of the top portion of a neckdown bag showing the mouth portion and a theoretical cylinder defining the inside girth of the mouth portion.

The mouth portion of the neckdown bag further comprises an upper mouth edge 36 defined by a generally upper boundary or extent of the mouth portion of the bag. The second inside circumference, C2, of the mouth portion of the neckdown bag is the inside circumference, or inside girth, of the narrowest or "waist" portion of the mouth portion. Referring to FIG. 3, the inside girth is definable as the girth C2 of the largest theoretical cylinder encompassable by the mouth portion of the bag, without substantial stretching or stressing of the bag. Inside girth and inside circumference as defined herein are in many cases synonymous. In alternate embodiments to be described (and possibly in embodiments not explicitly described herein but still within the scope and spint of this invention) where it may not be clear exactly what determines the "circumference" of the mouth, for the purpose of this invention, the inside girth defines the second inside circumference C2.

Figure 4A:
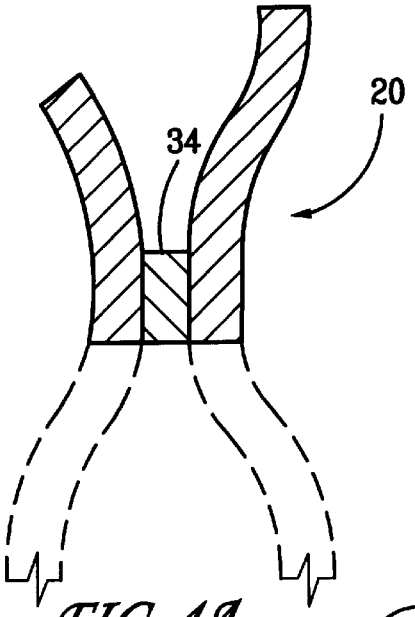
FIG. 4A is a partial cross sectional view, on an enlarged scale, taken on line 4—4 of FIG. 2, and illustrates one construction of a portion of a top seam portion of the neckdown bag of FIG. 2.
Figure 4B:
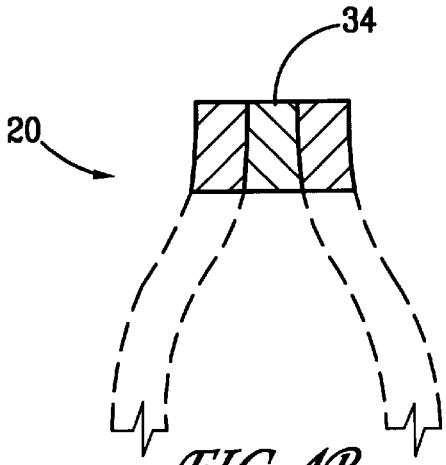
FIG. 4B is a partial cross sectional view, on an enlarged scale, taken on line 4—4 of FIG. 2, and illustrates another construction of a portion of a top seam portion of the neckdown bag of FIG. 2.

As stated, the top seam portion 20 comprises joining means 34 for joining or interconnecting the first and second flank portions of a pleat portion of a neckdown bag. For a given pleat portion, a top seam portion is generally taken to comprise the portion of the pleat's flank portions directly joined by the joining means (i.e. the seam proper, or seam), plus any and all outlying portions of the pleat's flank portions (i.e. "flashing" material outlying the seam proper), if any. Due to inaccuracies inherent in conventional fabricating tolerances, or due to intended methods of construction, different possibilities exist for describing the top seam portion. The seam, when formed by either a heat or fused seal or adhesive bond, and joining together the flank portions of a pleat portion, may be spaced somewhat away from the top, or uppermost, portion of one or both flank portions, as depicted in FIG. 4A, which is a partial cross section taken on line 4—4 of FIG. 2. In this case the top seam portion at this section would comprise the seam proper at this location and the outlying adjacent portions of the flank portions of the bag as shown. The excess portions outlying from the seam are the flashing, that is, excess edge portions of the bag that either intentionally exist or, as mentioned, are a result of not being able to accurately position the heat or fused seal or adhesive bond. In other constructions, or even along the same top seam portion at another section, both flank portions may join precisely at the top or uppermost points thereof. For example, such a case where no portions of the flank portions of the bag outlie the seam proper is shown in FIG. 4B, which is a partial cross section taken on line 4—4 of FIG. 2.

Figure 4C:
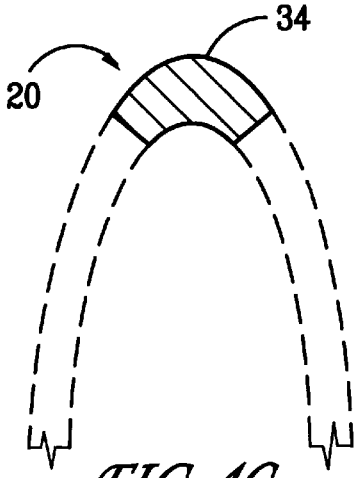
FIG. 4C is a partial cross sectional view, on an enlarged scale, taken on line 4—4 of FIG. 2 and illustrates another construction of a portion of a top seam portion of the neckdown bag of FIG. 2.

Referring to FIG. 4C of the drawings, which is a partial cross section taken on line 4—4 of FIG. 2, an alternate construction of the top seam portion is shown wherein the joining means for interconnecting the flank portions of a pleat is a joinder. A joinder generally refers herein to a continuous portion of the bag interconnecting two flank portions of the neckdown bag. The joinder typically continuously interconnects flank portions, and is a continuous extension of the bag film from the flank portions to the joinder portion. Indeed, as in typical bag constructions, a "unfolded" joinder results when, in constructing the bag, a sheet of plastic film is folded to overlay itself, with the u-fold sometimes made to form a sharp crease along the fold. Such a crease may be an area of weakening of the film material and may therefore be a site where a tear may initiate and propagate. Because a joinder is a continuous extension of the bag film between joinder and the flank portions thereadjoining, then obviously there are no portions of the bag outlying the joinder. In this case the top seam portion simply comprises the joinder itself.

Figure 5:
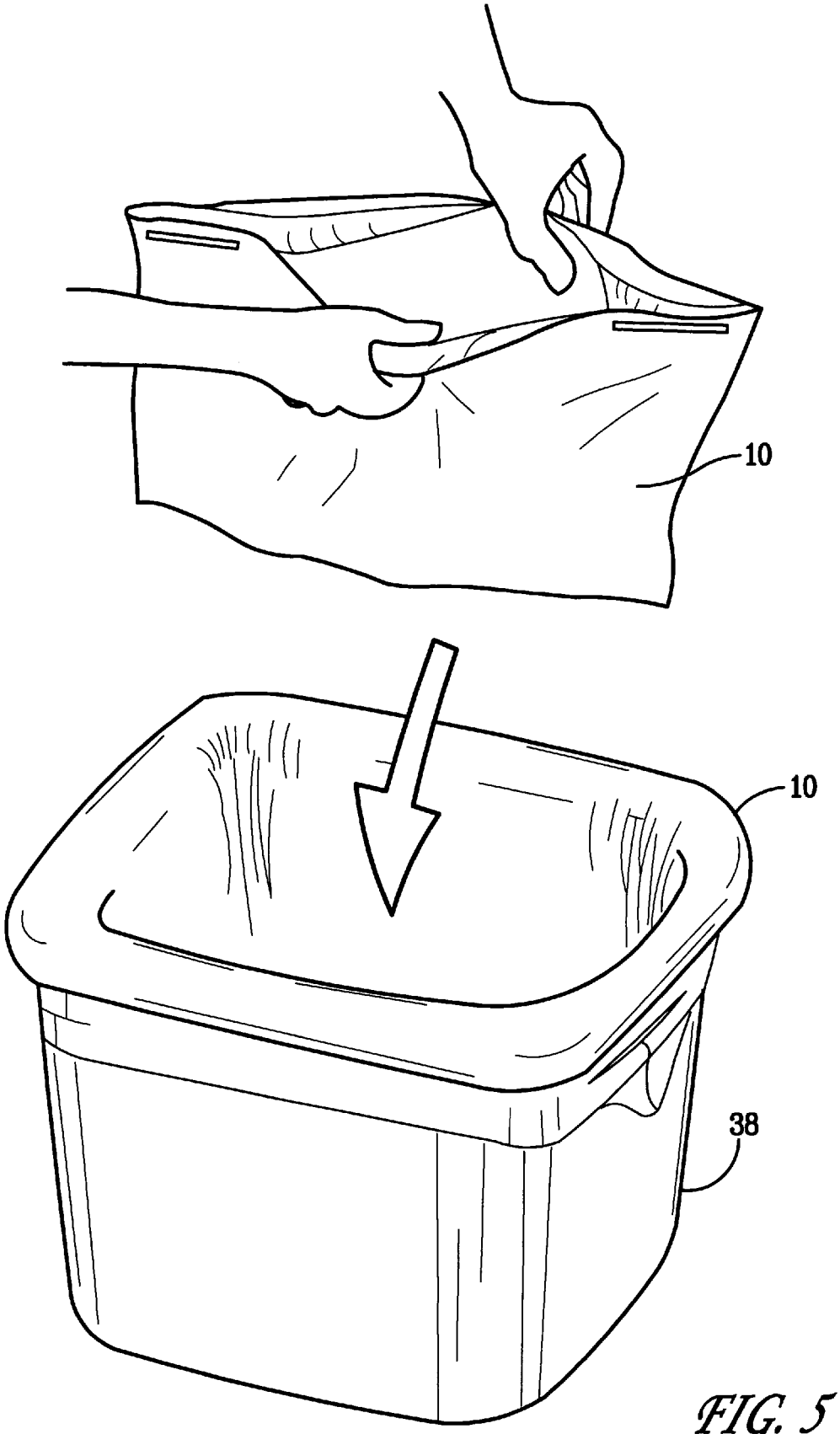
FIG. 5 is a perspective view of a pleated neckdown bag having two pleat portions, and being expanded by hand prior to fitting the mouth portion of the bag onto a supporting receptacle. The figure also shows the top portion of the bag fitted onto the receptacle.
Figure 6:
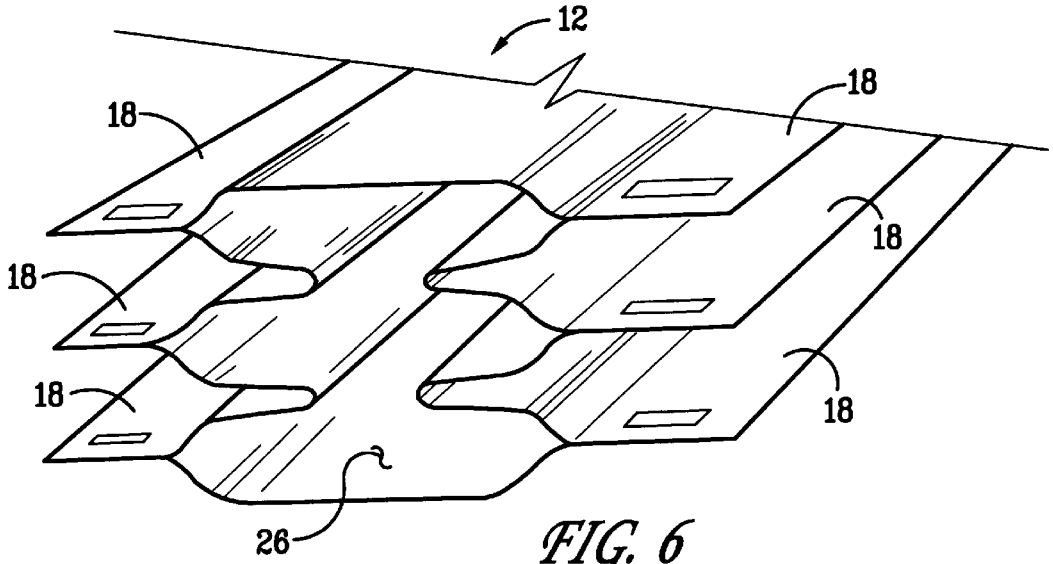
FIG. 6 is a perspective view of the top portion and mouth portion of a pleated neckdown bag having six pleat portions.

Referring to FIG. 5, a neckdown bag according to the embodiment herein described can then be expanded and the mouth portion fitted over a supporting receptacle 38. While at least one pleat portion is required to form the pleated neckdown bag, two or more may be used. By way of illustration, referring to FIG. 6 of the drawings, the top portion 12 of a neckdown bag is depicted having 6 pleat portions 18. A bag having pleats can be folded compactly and relatively unstressed for convenient packaging and storage. The use of more pleats in a neckdown bag may have advantages in that each pleat is apt to be subjected to relatively less stress upon fitting the bag onto a supporting receptacle because the total stretching that may be required can be divided amongst more pleats.

3. FLAT NECKDOWN BAG EMBODIMENTS

Figure 7:
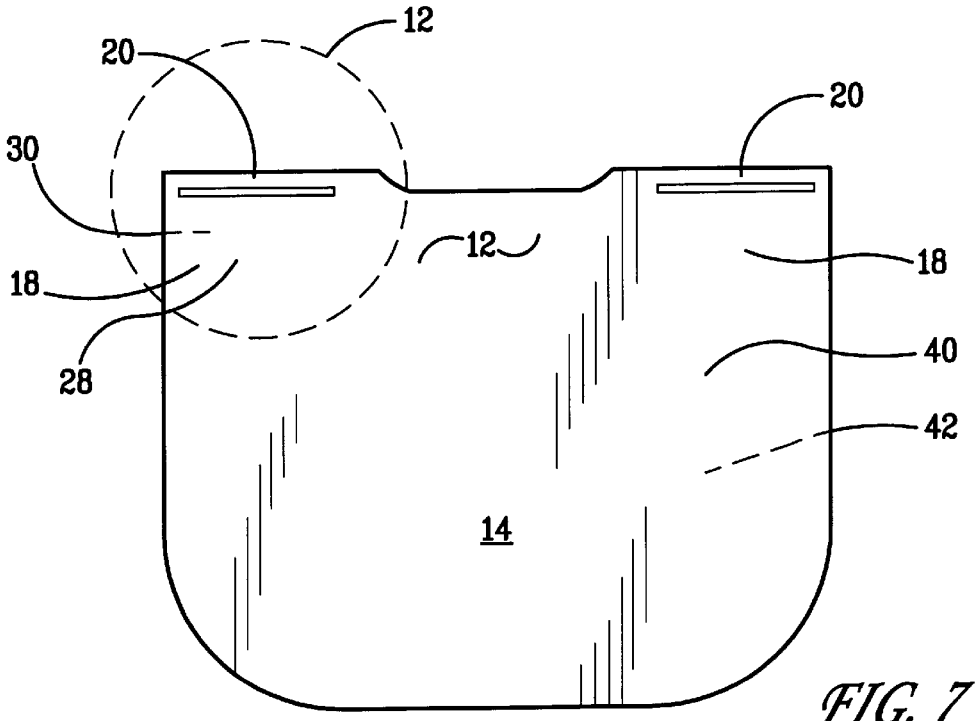
FIG. 7 is a plan view of an unexpanded pleated neckdown bag having a flat construction and having two pleat portions.

Now to be described are flat pleated neckdown bag embodiments. The flat bag embodiments presented are not intended to represent a limitation of the invention. Rather they are intended as representing a preferred embodiment of the present invention. Referring to FIG. 7 of the drawings, the neckdown bag of the present preferred embodiment possesses a "flaf" construction wherein the bag is able to repose in at least one unexpanded, or "flattened", state wherein the bag further comprises generally planar overlying first and second panel portions, 40 and 42, respectively. The first and second panel portions are approximately equal circumferential half portions of the neckdown bag. The first and second panel portions are able to lie substantially flat and substantially unstressed when the bag is in the unexpanded state.

In order to retain the essentially planar character of the flat neckdown bag construction, the bag in this flat embodiment comprises at least one, and at most two, pleat portions 18. The first flank portion 28 of a given pleat portion of the bag is then a portion of the first panel portion 40, and the second flank portion 30 of the same given pleat portion is a portion of the second panel portion 42 of the bag. Then when the bag is in the unexpanded state the first flank portion 28 of a given pleat portion overlies the second flank portion 30 of that pleat portion. In a flat bag embodiment, a top seam portion 20 interconnects the first and second flank portions of a given pleat portion along at least a portion of the top portion thereof. A top seam portion thereby interconnects the first and second panel portions across at least a portion of the top portion of the bag.

Figure 8:
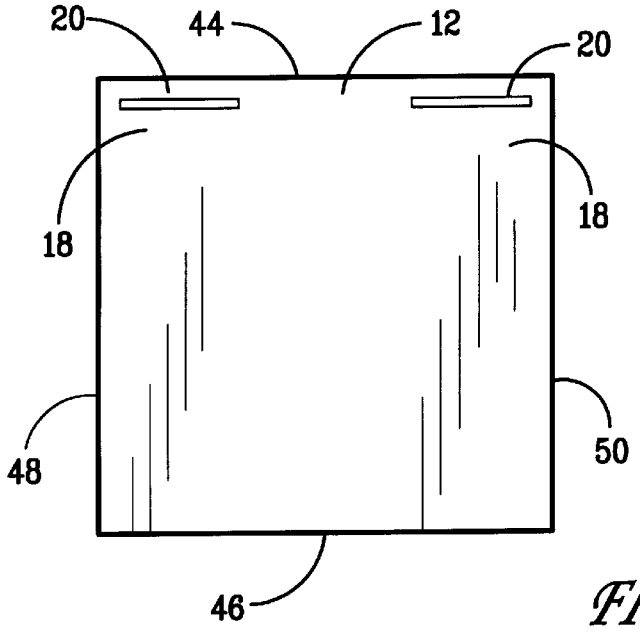
FIG. 8 is a plan view of an unexpanded pleated neckdown bag having a flat rectangular construction, and having in this case two pleat portions.

For a neckdown bag having a flat construction as described, many variations are possible regarding the planform shape of the unexpanded bag, that is, the shape of the bag when in the unexpanded state and when viewed from a direction generally normal to the first and second panel portions. Refer to FIG. 8 of the drawings which depicts just one contemplated embodiment termed a "rectangular bag". The rectangular bag possesses a four sided generally rectangular planform shape when in the unexpanded state. The top portion of the bag exhibits a top edge 44 generally defining an uppermost edge of the top portion of the bag and also defining one of the four sides of the rectangular planform shape of the unexpanded bag. The rectangular bag in the flattened state further exhibits a bottom edge 46 generally defining a bottommost edge of the rectangular bag and wherein the bottom edge is generally parallel to the top edge. The first and second panel portions are joined together across the bottom edge. The bottom edge defines another side of the four sided rectangular planform shape of the bag whereby the top and bottom edges respectively define opposite sides of the four sided rectangular shape of the bag in the unexpanded state. The rectangular bag, when in the unexpanded state, further exhibits a first side edge 48 and a second side edge 50, each side edge being oriented generally perpendicular to the top and bottom edges and each side edge extending therebetween. The first and second side edges define respectively the remaining two opposite sides of the four sided rectangular planform shape of the bag in the unexpanded state. The first and second panel portions are joined upwardly and downwardly along the first side edge, and upwardly and downwardly along the second side edge. A top seam portion 20 is generally elongate in a direction extending generally perpendicular to a side edge.

A pleated neckdown bag having a flat construction, and especially a flat rectangular bag, offers certain advantages. In particular, a neckdown bag having a flat construction is convenient to manufacture and package and can be efficiently mass produced typically from a flat continuous sheet or sheets of film or from a tubular extruded film. A flat neckdown bag lends itself to efficient production of individual bags, or of a continuous series of connected bags joined at their common boundaries by joinder sections having a spaced series of perforations between the joinder sections to permit efficient separation by forcing apart one bag from an adjacently joined bag. Individual or connected bags can be easily packaged such as in a rolled, folded, or flattened form for packaging, shipping, and for later convenient removal as needed.

4. TABBED NECKDOWN BAG EMBODIMENTS

Tearing of a neckdown bag, usually near the mouth, is possible on installation if tension is imposed on the bag during installation and service. For example, a tear may be initiated at or near point "A" in FIG. 2 where the inwardmost end of a top seam portion of the bag restricts the mouth portion. A tear, once initiated, may continue to propagate preferentially along a top seam, and depending on the extent of the tear, may impair the ability of a neckdown bag to remain engaged with its support. Susceptibility to tearing is a function of many factors, such as the strength of the bag film at the seam, and the type and geometry of the seam. In some cases these factors are such that there is little or no chance of a tear occurring in normal use, and in this case there is no need to provide further means to prevent this occurrence. The present bag embodiment, termed a "tabbed" neckdown bag embodiment, provides for a stress and strain modifying tab means to advantageously modify the stress and strain at and near the conjunction of a seam and mouth portion of a neckdown bag. The tab is intended to reduce the possibility of tearing of a neckdown bag, and especially of a top seam portion thereof, in the neighborhood of the tab.

4.1 General Tab Embodiment

Figure 9:
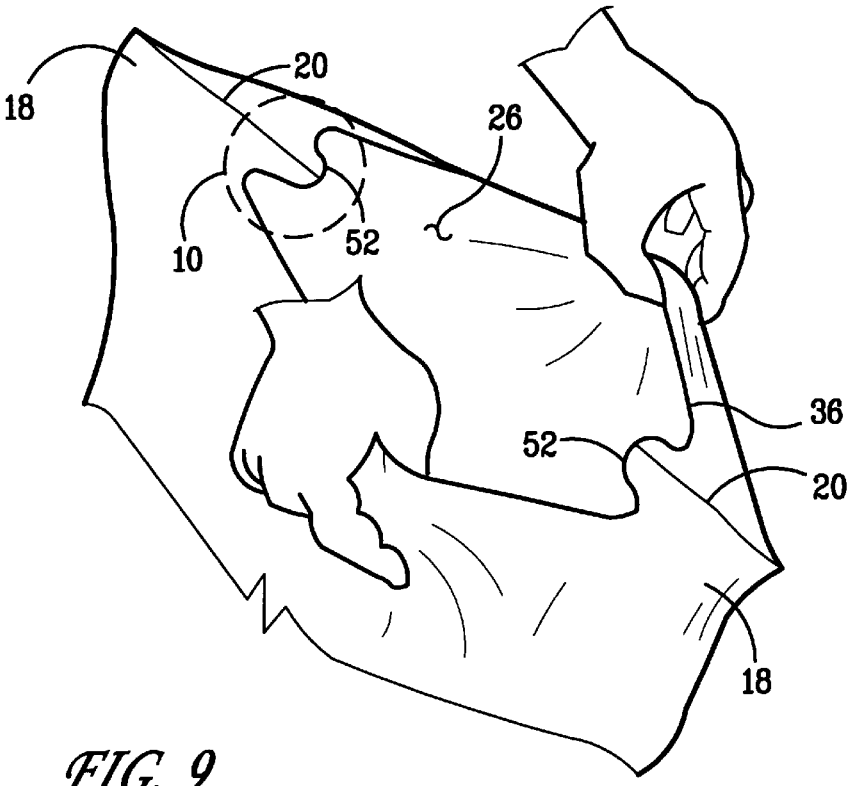
FIG. 9 is a top perspective view of the top portion of a pleated neckdown bag having two pleat portions, and having stress modifying tabs disposed at the juncture of the mouth portion and each of the two top seam portions of the bag.
Figure 10:
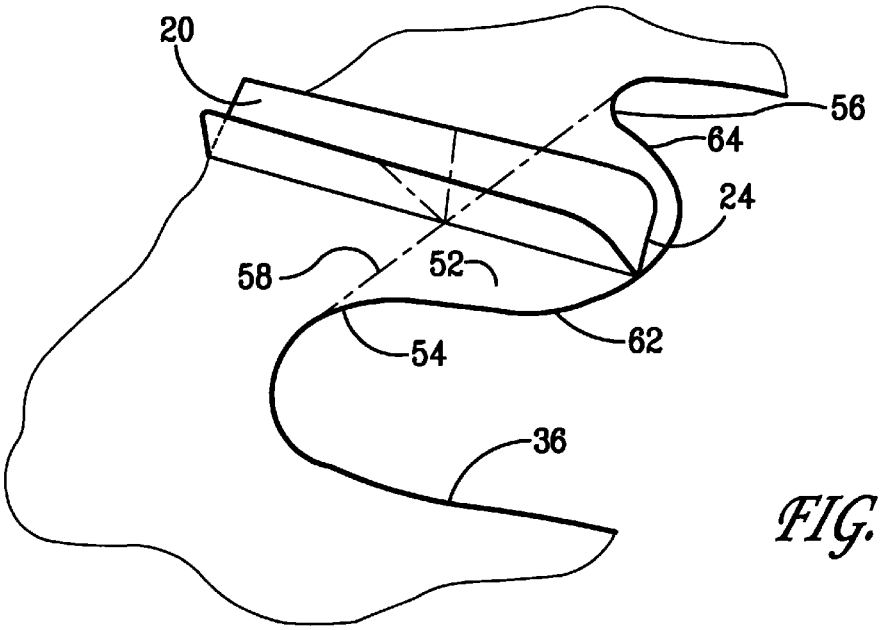
FIG. 10 is an enlarged detail, taken from FIG. 9, of one of the tabs of FIG. 9, and illustrates one particular tab embodiment along with various elements of the tab.

Referring to FIG. 9 of the drawings, the preferred embodiment is a stress modifying "tab" 52, disposed at the juncture of the mouth portion 26 and a top seam portion 20 of the bag. Referring now to FIG. 10 of the drawings, an enlarged detail of a tab from FIG. 9 is shown. In a preferred tab embodiment, a portion of the bag at the mouth edge 36 projects, or extends, away from the portion of the bag adjacent the mouth edge, between first 54 and second 56 concave, or reentrant arcuate portions (that is, the arcuate portions are directed inward, toward the bag film, as opposed to away therefrom) of the mouth edge, thereby forming a tab 52. A tab is a "finlike" cantilever extension of a portion of the bag adjacent a portion of the mouth edge. The tab thereby projects from a tab base 58 between the first and second arcuate portions of the mouth edge.

More particularly, the mouth edge further comprises at least a first mouth edge portion 62 and a second mouth edge portion 64 thereof. Each of the first and second mouth edge portions extends from the inwardmost end of a top seam portion 20 of the bag, and each follows the mouth edge generally away from that top seam portion 20. The first mouth edge portion further comprises at least the first reentrant arcuate portion, 54, and the second mouth edge portion further comprises at least the second reentrant arcuate portion, 56.

The tab base 58, which lies in the bag film, is generally defined between the first and second arcuate portions, 54 and 56, of the mouth edge, and is preferably tangent to these arcuate portions. The tab base 58 is a descriptive boundary between the tab portion of the bag and the remaining portions of the bag, and defines the general area of attachment of the tab portion of the bag to the remaining portions of the bag. The tab base does not necessarily designate an abrupt change in bag film material across the base. Thus, in a preferred embodiment of a tabbed neckdown bag, the bag, including the top seam portion thereof, is continuous across the tab base. The first mouth edge portion 62 extends between and contacts the tab base 58 and the inwardmost end 24 of the top seam portion 20 of the bag, and the second mouth edge portion 64 extends between and contacts the tab base 58 and the inwardmost end 24 of the top seam portion 20 of the bag. The tab base thereby intersects the top seam portion of the bag intermediate the inwardinost and outwardmost ends thereof. That is, at least a portion of the top seam portion 20 that is intermediate the inwardmost 24 and outwardmost 22 ends thereof extends across the tab base.

Figure 11A:
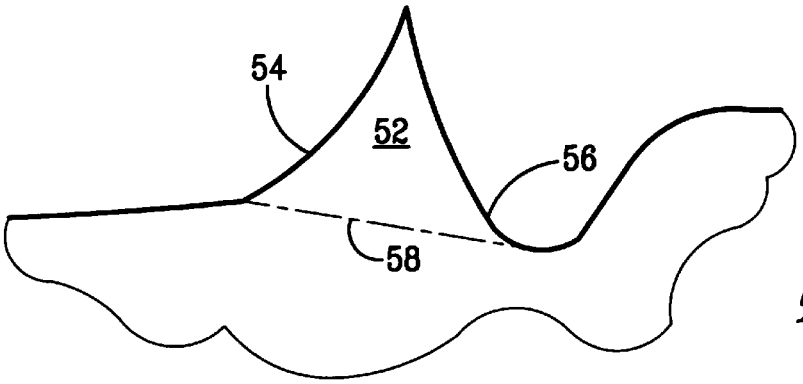
FIGS. 11A and 11B are each plan views of tab embodiments where a tab base cannot be uniquely defined tangent to both the first and second arcuate portions. The illustrations indicate how the first and second arcuate portions can still define a tab base therebetween.
Figure 11B:
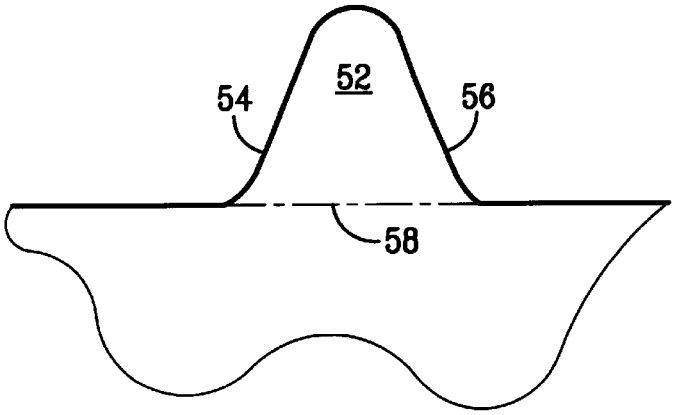

In cases where a tab base cannot be uniquely defined by a tangent to both the first and second arcuate portions, then a tab base may be defined tangent to at least one of the first or second arcuate portions, and the tab base at least contacts the remaining reentrant arcuate portion at some point on the arc, preferably at a point giving the largest tab possible. For example, FIG. 11A of the drawings illustrates a case where the first and second arcuate portions, 54 and 56 respectively, do not define a unique tab base 58 tangent to both arcuate portions. However, a tab base 58 is reasonably defined tangent to at least one of the first or second arcuate portions and contacting the other arcuate portion at a terminus giving the largest possible tab. In other cases perhaps a tab base 58 is not definable tangent to either of the first and second arcuate portions of the mouth edge, such as the case shown in FIG. 11B. In such cases a tab base may be definable as contacting each reentrant arcuate portion at some point on the arc, and preferably at a point giving the largest tab possible. In the above cases, and any cases not illustrated herein but where one of the above descriptions makes sense, hereinafter the tab base will be generally described as being defined between the first and second arcuate portions of the mouth edge.

A tab as described herein is a "finlike" cantilever extension of a portion of the bag adjacent a portion of the mouth edge, the tab projecting from the tab base between the first and second arcuate portions of the mouth edge. What is meant by "cantilever extension" is that the tab 52 portion of the bag is supported from, or attached to, the remaining bag only along the tab base 58 or at least a portion thereof.

4.2 Tab for a Flat Bag

A tab embodiment for a flat bag is now disclosed. The preferred tab embodiment to be described is usable in a flat bag construction as hereinabove described. A flat bag having one or more such tabs retains the generally planar construction of the previously described flat bag embodiment, with all the attendant advantages thereof. The present tab embodiment retains all the previously described elements of the preferred tab embodiment described hereinabove.

Figure 12:
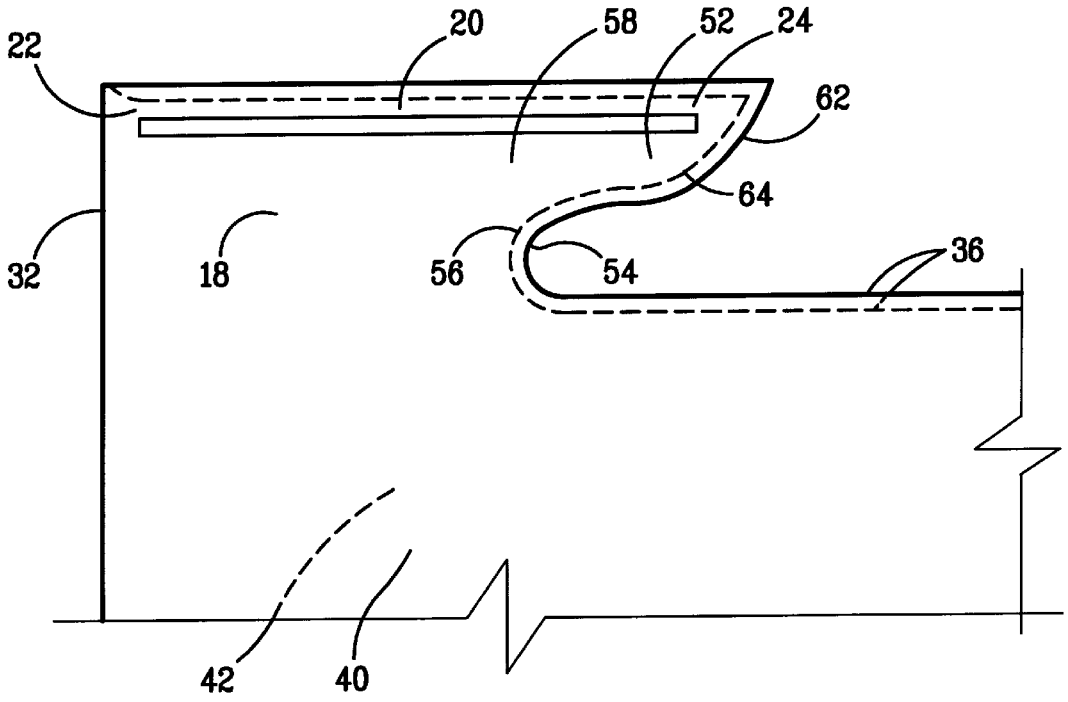
FIG. 12 is a partial plan view of a pleat portion detail of a flat neckdown bag taken from FIG. 7 and shows a tab embodiment suitable for a flat bag construction.

Refer now to FIG. 12, which is an enlarged detail of the flat bag of FIG. 7, except a tab embodiment for the flat bag is depicted in FIG. 12. As before, a portion of the bag at the mouth edge 36 projects between first 54 and second 56 reentrant arcuate portions of the mouth edge forming a tab 52. Again, the tab 52 projects from a tab base 58 defined between the first and second arcuate portions, 54 and 56, of the mouth edge. As with the general tab embodiment, the mouth edge further comprises at least first 62 and second 64 mouth edge portions thereof, each of the first and second mouth edge portions extending from the inwardmost end 24 of a top seam portion 20 of the bag, and following the mouth edge 36 generally away from the top seam portion 20. As before, the first mouth edge portion 62 further comprises at least the first reentrant arcuate portion, 54, and the second mouth edge portion 64 further comprises at least the second reentrant arcuate portion, 56. In this tab embodiment for a flat bag, the first mouth edge portion 62 is a portion of the first panel portion 40 of the bag, and the second mouth edge portion 64 is a portion of the second panel portion 42 of the bag.

Figure 13A:
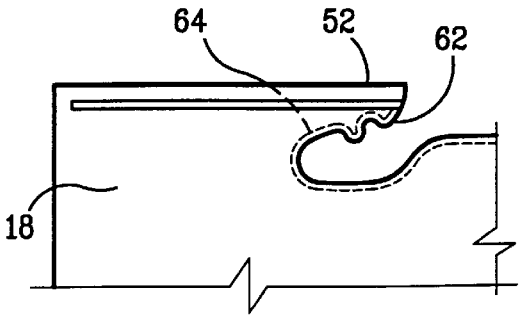
FIGS. 13A–13F are partial plan views, similar to that of FIG. 12, of a pleat portion detail of a flat neckdown bag, each figure showing an alternative embodiment of a tab construction for a flat neckdown bag.
Figure 13B:
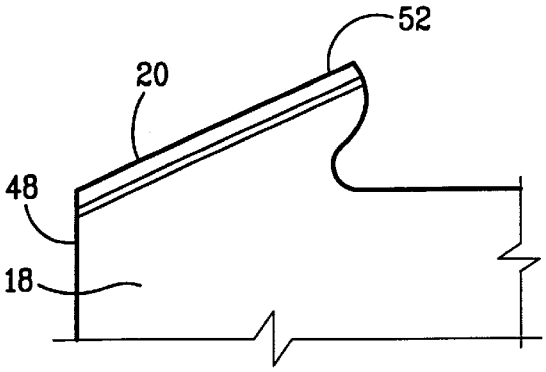
Figure 13C:
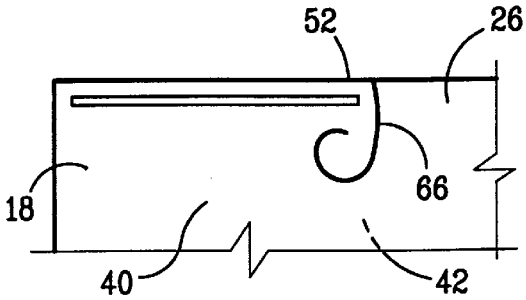
Figure 13D:
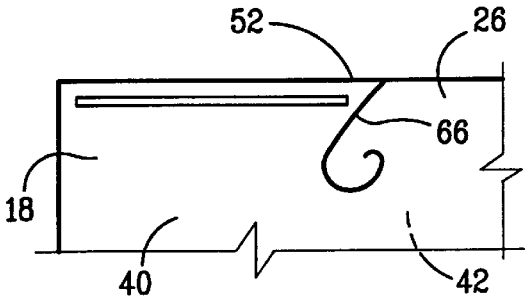
Figure 13E:
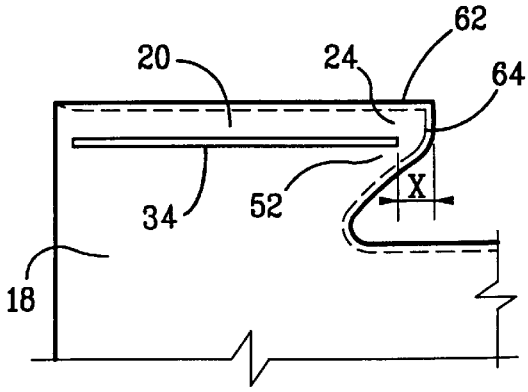
Figure 13F:
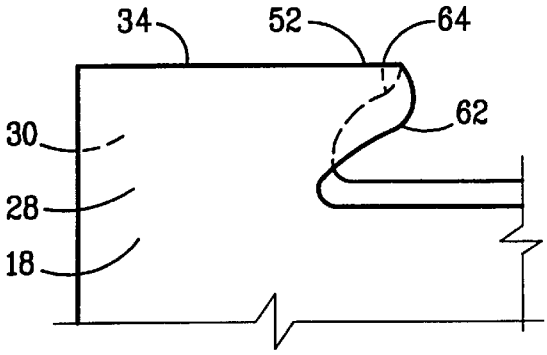

Referring to FIGS. 13A through 13F of the drawings, several examples of tab embodiments for a flat bag are shown for illustration purposes, and not by way of limitation. All of the FIGS. 13 show a detail similar to FIG. 12 of a flat bag having a tab. FIG. 13A shows a tab 52 having irregular but overlying first 62 and second 64 mouth edge portions. In FIG. 13B the top seam portion 20 of the tabbed bag is not perpendicular to the side edge 48. FIGS. 13C and 13D show tabs produced in a flat bag by a recessed cut 66 made through both first 40 and second 42 panel portions and adjacent the mouth portion, 26, so as to produce a tab 52. In FIG. 13C the cut 66 curls in toward the tab, and can be made so that no excess, or drop-away, of bag film material results from the cut (such as by die cutting). Essentially the same result can be obtained with a cut that curls out from the tab as in FIG. 13D. In FIG. 13E the joining means 34 interconnecting the flank portions of the pleat portion 18 (the joining means being perhaps a heat or filsed seal, or adhesive bond) terminates shy by an amount "X" from first and second mouth edge portions, 62 and 64, yet the first and second mouth edge portions contact the inwardmost end 24 of the top seam portion 20. A "short seam" such as depicted in FIG. 13E may occur as a result of inaccuracies inherent in the fabrication of the bag, or may be intentional. In FIG. 13F, the joining means 34 interconnecting the first and second flank portions, 28 and 30, of the pleat portion 18 partway across the top portion of the flat bag is a unfolded joinder. Also the tab 52 is not symmetrical, the first mouth edge portion 62, does not match the shape of the overlaying second mouth edge portion 64, yet the tab is compatible with a flat bag embodiment.

TAB PERFORMANCE

1. ANALYTIC STUDY

An analytic investigation was conducted to study the effectiveness of a tab to modify the stresses and strains in and near the tab to reduce the likelihood of a tear occurring at a seam passing near to or into (that is, passing "in the neighborhood of") a tab portion of a bag. To this end, idealized two dimensional analytical models were constucted of a tab and immediately adjacent portion of a bag film using a numerical finite element method (FEM) implemented on a digital computer. The FEM models were then used to simulate and study the effect of a tab on the stresses in a bag film.

1.1 Detailed FEM Model Descriptions

Figure 14:
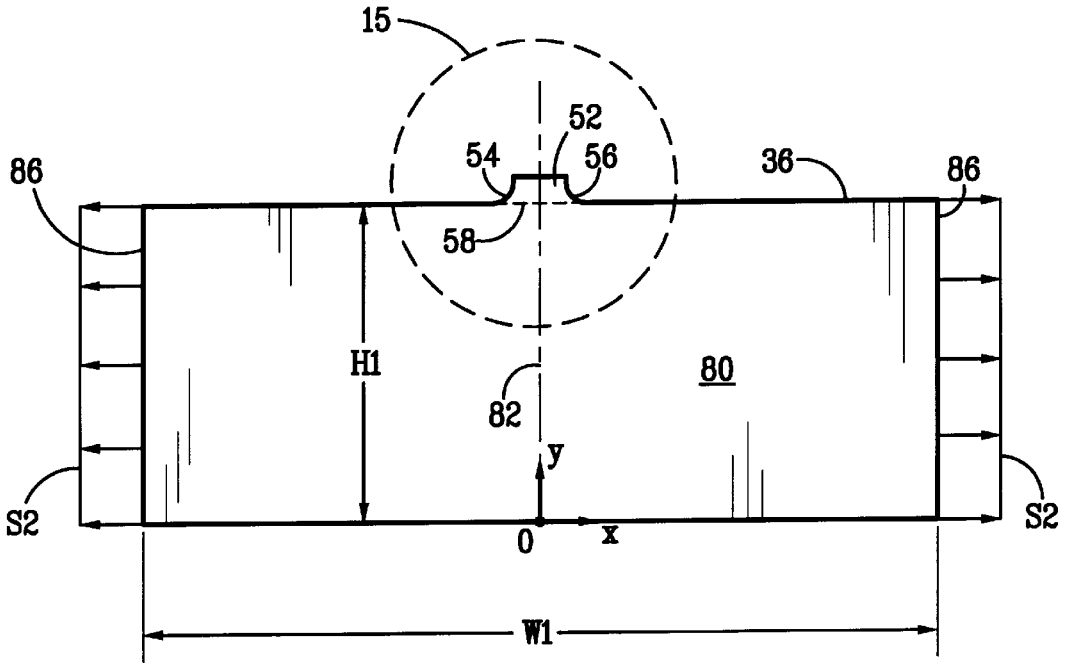
FIG. 14 is a plan view schematic of a 2 dimensional geometric model of a tab and a portion of a bag adjacent the tab. The model is a representation of that used to numerically simulate effects of a tab on the distribution of stress and strain in the bag film in the neighborhood of the tab.

In FIG. 14 of the drawings, a depiction is given of a geometric FEM model which was used to simulate the effect of the tab on the stresses and strains in the bag film in and near the tab. Both the tab 52, and an adjacent portion 80 of the bag film adjoining and immediately adjacent the tab, were modeled. The adjacent portion 80 of the bag film in all cases had an initial unstressed width, W1, of 7.5 inches and an initial unstressed height, H1, of 3.00 inches. An arbitrary coordinate system is conveniently defined in FIG. 14 for the analytic models, with the origin at point "O", and the positive "X" direction oriented perpendicularly away to the right from a line of symmetry 82, or tab centerline, passing through the center of the tab and dividing the model equally. The positive "Y" direction of the origin is then oriented along the line of symmetry toward the tab. Circular fillets were used to model the reentrant arcuate portions, 54 and 56, of the tab. A tab base 58 is defined between these arcuate portions.

Several different tab geometries, or styles, were investigated. More particularly, rectangular, triangular, and circular tab styles were investigated. Examples of these tab styles are shown as enlargements in FIGS. 15A, 15B, and 15C of the drawings, each showing a tab detail from FIG. 14, and showing the rectangular, triangular, and circular tab styles, respectively. Each of these particular tab styles refers to the general shape of a free edge 84 of the tab in the respective model used in this study. For the purposes of this study, for each analytic tab model, both arcuate portions, 54 and 56, and the portion of the mouth edge 36therebetween define a free edge of the tab (no external force or prescribed displacement was applied to the free edge in the FEM simulations). The rectangular, triangular, and circular style names refer generally to the shape of the portion of the free edge of the tab between the first and second arcuate portions, as depicted in the FIGS. 15A, B, and C.

For the purposes of the study, and referring again to FIGS. 15 of the drawings, the following terms are further defined: the tab width, W2, the tab height, H2, and the fillet radius, R1. The tab width W2 was taken as the overall width of the tab at the base including the arcuate portions (i.e. the tab width was the length of the tab base). All the tab models were constructed with a tab width of ⅞ inches which was equal to the spacing of the centers of the circular fillets. In all cases the radius R1 of the circular fillet arcs was 3/16 inch. The tab height, H2, is taken as the overall height of the tab region measured perpendicularly from the tab base 58. A height-to-width "tab height ratio" for each tab was defined as the ratio of the tab height H2 to the tab width W2, expressed as a percentage (i.e. tab height ratio=100×H2/W2).

Figure 15A:
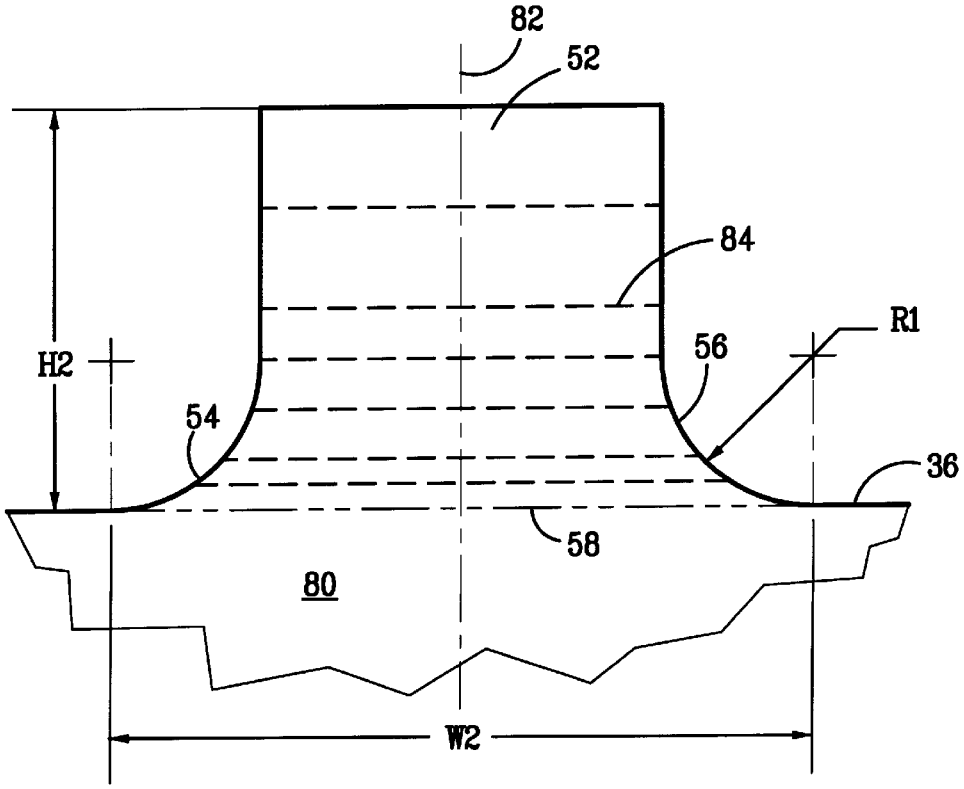
FIGS. 15A–15C are enlarged details of the tab of FIG. 14, showing, respectively, a rectangular, a triangular, and a circular tab style for the tab, each figure also indicating the parametric models used to investigate effects of tab height ratio on stress in the neighborhood of a tab.

For each of the three tab styles studied the effect of varying the tab height ratio on tab performance was also investigated. To this end, for each tab style, a series of tab models were constructed with each model having a different tab height ratio obtained by parametrically varying only the tab heights (keeping the tab width fixed). In particular, the following tab heights were investigated: 1/32, 1/16, ⅛, 3/16, ¼, and ⅜ inches, corresponding to tab height ratios of 3.57, 7.14, 14.3, 21.4, 28.6, 42.9 percent, respectively. In addition, a rectangular style tab model having a tab height of ½ inch (corresponding to a tab height ratio of 57.1 percent) was also investigated. The different tabs modeled are indicated in FIGS. 15A, B, and C by the free edge 84 of each tab. The "no-tab" model was an anytic FEM model ofjust the 7.5×3.0 inch adjacent portion of the bag film alone; that is, there was no tab for this "no-tab" model. This no-tab model was used as a baseline to compare with the results of the models having tabs.

Referring now back to FIG. 14 of the drawings, an externally applied 1000 psi (lbf/sq.in.) tensile edge stress, S2, directed away from the line of symmetry and parallel to the "X" direction, was imposed along the entire length of the side edges 86 of the adjacent portion 80 of the bag film to simulate a tensile force being applied to the bag mouth. The bag film material in all cases was modeled as an elastic material having uniform properties throughout with a young's modulus of 25,000 psi and a poisson's ratio of 0.3. These properties were selected to attempt to simulate approximately the elastic properties of a plastic film such as a low density polyethylene (LDPE). Only all elastic material response was considered in the study.

The analytic models described above and used for this study may in some cases idealize or simplify real bag and tab geometries and real bag film material responses. Even so, it is believed that the models are still useful to some extent for describing the effect of a tab on stresses and strains that might figure in the tearing of a bag film in and near a tab. It is therefore understood that the results of this study may have broader application than the limited specific geometries, and specific parameters such as film type and film properties, etc., used in the idealized tab models presented. The results and conclusions of this study may generally hold even for other tab geometries and parameter values, and for other, possibly more complex, bag film material responses. Furthermore, though the models may offer insights into the possible mechanisms useful to successful tab performance, it is also understood that, due to simplifications made, there may be other phenomena not evident in the results here presented that may contribute to successful tab performance and, though not evident in these results, should in no way limit the scope of the present invention.

1.2 Results of the Analytic Study

Figure 16:
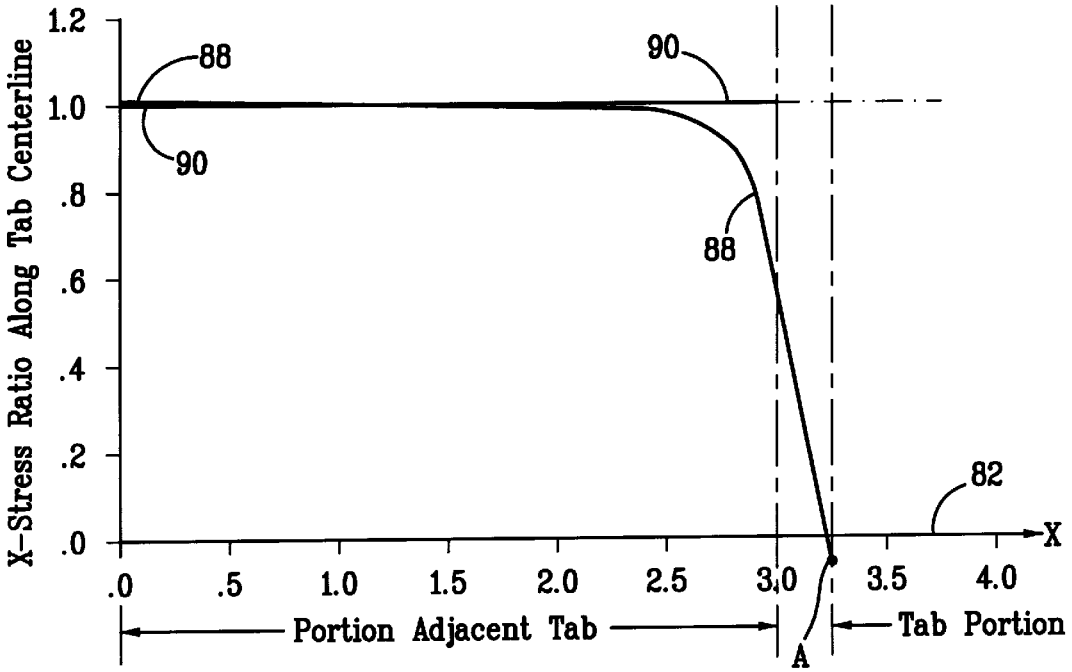
FIG. 16 is a graphic representation illustrating the estimated stress reduction effect of a tab on the x-stress ratio along the centerline of a tab, and in the adjacent bag film in the neighborhood of the tab The data simulate stresses that might develop in a bag with and without a tab when the bag is subject to a tensile stress.

When a stress develops at or near a seam in a bag, components of the stress that act more or less perpendicularly to the length of the seam may drive the initiation and subsequent propagation of a tear at a seam. Since in a preferred tab embodiment a tab is so positioned that a seam passes near, or directly along, the centerline of the tab, it is generally useful to present how the stresses developed about the centerline, 82, of the analytic tab models. To this end, referring to FIG. 16 of the drawings, the figure shows a graph of the FEM estimated "X" direction normal stress, or simply "x-stress", developed in the film, in terms of a "stress-ratio" 88 along both the centerline of the tab and the adjacent portion of the bag film. Results are shown for the rectangular, triangular, and circular tab styles, for tabs having a height ratio of 28.6 percent (i.e. for the modeled tabs having a ¼ inch tab height). The results for each of the three tab styles are virtually identical and hence distinguish essentially as one curve. FIG. 16 also shows a straight horizontal line, 90, indicating an x-tress ratio result of 1.00 obtained for the no-tab case.

A "stress ratio" used herein is a normalized stress generally defined as the value of a stress component divided by the nominal applied stress (in all the analytic cases studied the nominal applied stress was 1000 psi). The x-stress ratios for the no-tab model are equal to 1.00 at every point in the no-tab model. The stress ratio serves to indicate a measure of stress modification, that is, it indicates the difference in a stress component, as compared to the corresponding stress developed in the no-tab model. In general, stress ratios for corresponding stress results for different tab models can be used to compare the performance of one tab geometry versus another. In short, the stress ratio measure allows straightforward comparisons between tab models, and comparisons as to how a tab might advantageously modify stresses in the bag as compared to a bag having no tab or to a bag with a tab having a different tab geometry.

In FIG. 16 the x-stress ratios along the tab centerline are markedly reduced in and near the tab in all three tab styles, relative to the no tab case. The stress reduction occurred not only within the tab, but extended into the adjacent portion of the bag film for a distance of about one tab width. The x-stress ratio at the tip of the tab (that is the x-stress at point "A" in FIG. 16 at the point X=0, Y=3.25 in the tab model) where a seam passing into or through the tab might terminate at the free edge of the tab, has decayed by this point to essentially zero (the stress has actually become slightly compressive in all three cases). This result represented a 100 percent reduction in the x-stress at the tab edge as compared to the edge stress in the no-tab case (the tab edge corresponded to the mouth edge of a real neckdown bag). While the reduced x-stress results are presented here along the line of symmetry of the tab, the x-stresses were reduced in the tab regions and the adjacent portion of the bag film even away from the tab line of symmetry. However, it is believed more useful in regards to the greater tab regions to present a more general stress function, namely the "First Principal Stress", to be presented now.

Figure 17:
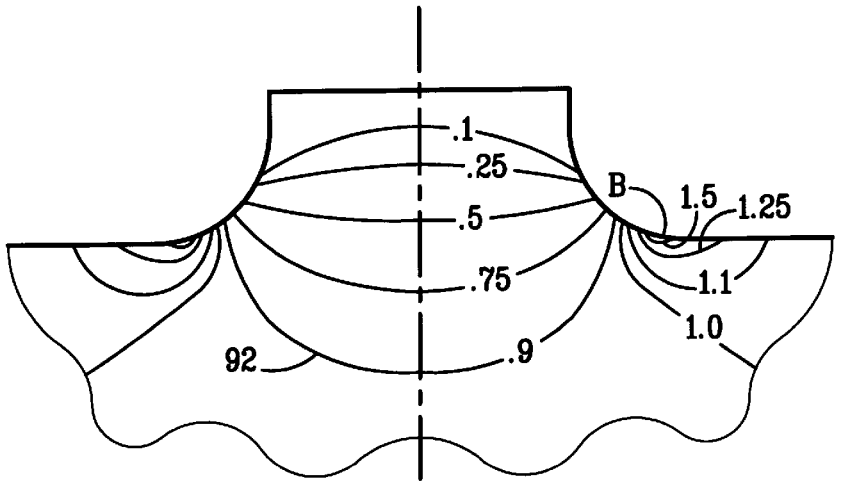
FIG. 17 is a graphic representation of estimated distribution of the First Principal Stress in and near the rectangular tab model, for a tab having a height ratio of 28.6 percent, and when the tab model was subject to a tensile stress simulating stressing of a tabbed bag in the vicinity of the tab.

The algebraically largest normal stress component at a given point in a stressed body is generally the First Principal Stress, or FPS (the FPS is defined herein in the usual sense taken in the science of mechanics of materials). The presence of a tab was found to result in a zone of reduced First Principal Stress in the tab and bag portion adjacent the tab, relative to the no-tab case, again for all three tab styles. The FPS stress ratio is here defined similarly to the x-stress ratio, that is, the FPS stress ratio at a point is the FPS value divided by the nominal applied stress, the nominal applied stress being equal again to 1000 psi. FIG. 17 shows estimates of lines of constant FPS stress ratio 92 in the tab, and the adjacent portion of the bag film near the tab, for the rectangular tab model having a height ratio of 28.6 percent (i.e. the rectangular model having a ¼ inch tab height). In FIG. 17, except for localized regions at and near the arcuate portions of the free edge of the tab and at and near the (free) mouth edge portions outlying the tab, the FPS stress ratios within the tab and in a portion of the adjacent portion of the bag film, were substantially below one. The result is especially marked and of greatest extent along the tab centerline. Similar results were obtained for the other tab styles studied. That the tab models developed reduced FPS stress ratios near the tab and virtually everywhere in the tab (except the small region near the fillets, as explained further below) perhaps explains in whole or in part why the tab may preclude a tear occurring in or near a tab and particularly in a seam passing in the neighborhood of the tab where the FPS stress ratio is generally reduced.

1.3 Effect of Different Tab Height Ratios

Figure 15B:
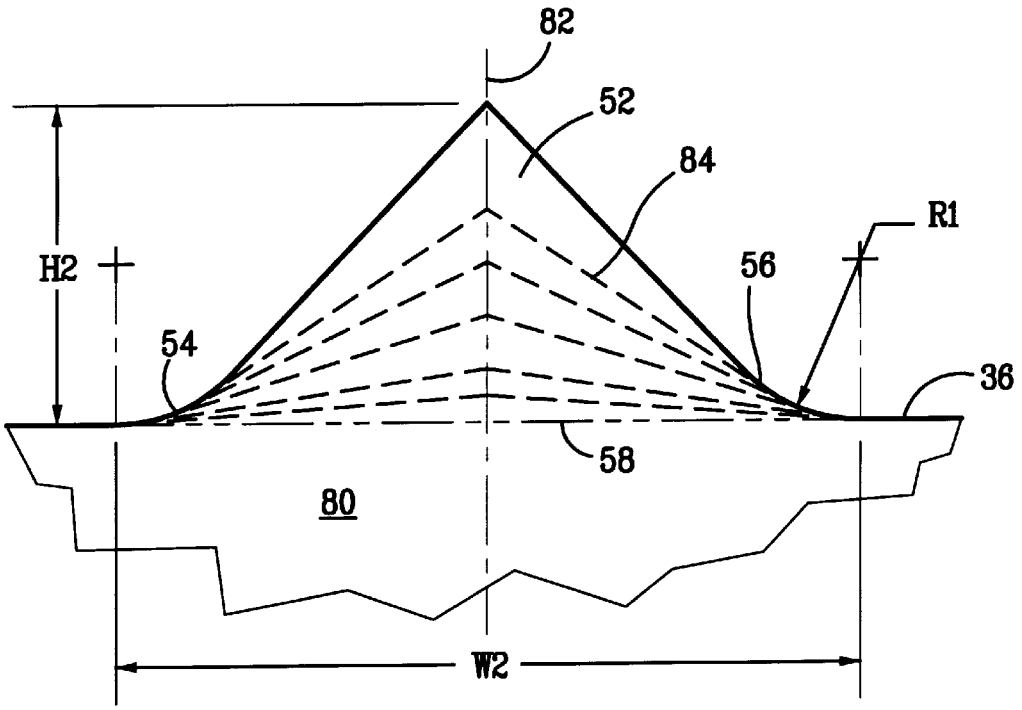
Figure 15C:
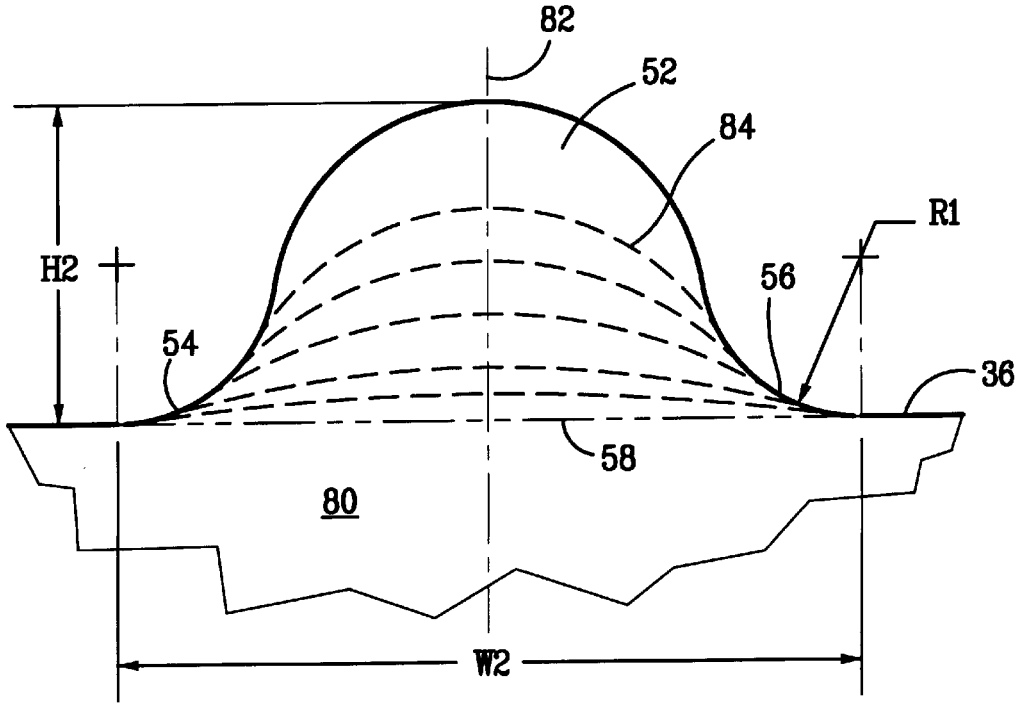

The above results pertained to the rectangular, circular, and triangular tab models having a tab height ratio of 28.6 percent. The effect of varying the tab height ratio for each tab style was also investigated. To this end, tab height ratios were varied by varying the tab height for each tab style while keeping the tab width fixed. For example, for the rectangular tab, the tab height was varied from 1/32 to ½ inch, as described hereinabove, representing a tab height ratio range of 3.57 to 57.1 percent. Examples of the tab profiles 84 are shown in FIGS. 15A, 15B, and 15C of the drawings. The results of this investigation are summarized in FIGS. 18 and 19 of the drawings.

1.4 Effect of Tab Height Ratio on X-stress at Tab Tip

FIG. 18 shows a graph of FEM estimates of x-stress ratio occurring at the free edge of the tab on the tab centerline (i.e. the tip of the tab, or point "A" of the figure) versus tab height ratio, for the three tab styles. Curve 94 shows the effect of tab height ratio on x-stress at the tab edge for the rectangular tabs, curve 96 for the circular tabs, and curve 98 for the triangular tabs. For all the tabs analyzed, marked x-stress ratio reductions occurred relative to the no-tab case, the triangular tab performing the best in this respect. Furthermore, the data indicate that for all three tab profiles, the x-stress ratio at the tab tip initially decreased strongly from a value of 1.00 as the tab height increased from zero. This suggests that any positive tab height ratio in the range investigated may cause a decreased x-stress ratio relative to the case for no-tab. After a point as shown in FIG. 18, increasing the tab height did not result in a significant additional decrease in tab tip x-stress. It was found that for the three tab styles, at a tab height ratio of about 28 percent the x-stress at the tip of the tab is essentially zero. Tabs in the models having tab height ratios greater than this value developed a small compressive x-stress at the tip of the tab. Since in a real flexible film, even a relatively small compressive stress will usually result in harmless buckling (wrinkling) of the film, with no further appreciable increase in compressive stress possible after buckling, the results here suggest that, in general, for a tab having a height greater than about one-third the tab width, that is a tab having a height ratio of about 33 percent or greater, the x-stress at the tab tip will be virtually zero, i.e. so low as to be negligible in effect. Thus from a stress reduction point of view, it appears unnecessary, though certainly not disadvantageous in this regard, to have tab height ratios greater than about one third.

1.5 Fillet Stresses

As mentioned, areas of increased FPS stress ratios, were found to occur in the tab near the arcuate portions of the free edge of the tab and in immediately adjacent local regions of the bag. In FIG. 17, the areas of increased FPS stress ratio occurred in the rectangular tab model at the base of the fillets near where they contacted the tab base, and extended into the adjacent portion of the bag film generally away from the tab centerline while following the mouth edge 36 portion of the adjacent portion of the bag film (equivalent to a mouth edge portion of a bag) for a short distance. It was found that another stress function, the "Von Mises" stress, approximately mimicked the FPS stress ratio patterns and values in and near the tabs. The Von Mises stress, defined here in the usual classical strength of materials sense, when compared to yield strength of a material, is known to be a key indicator of the onset of material yielding under load. If under load, the Von Mises stress is near the yield stress of the material, it is an indication that any further increase in load may result in some yielding and plastic deformation of the material at that point.

In all cases the maximum FPS and Von Mises stress ratios occurred at the base of each fillet, approximately as at point "B" in the fillet shown in FIG. 17. Refer now to FIG. 19, which shows graphs of estimated maximum Von Mises stress ratio occurring at the base of the fillet regions of the FEM models versus tab height ratio, for the three tab styles. The Von Mises stress ratio increases with increasing tab height ratio to about a maximum of about 1.6 for the rectangular 100, circular 102, and triangular 104 tabs, the maximum occurring at height ratios of between 20 and 30 percent or more (once again, the triangular tab generally gave the lowest stress ratios). Further increases in tab height ratio induced no significant additional increase in Von Mises stress ratio. This data, together with the tab tip stress data in FIG. 18, suggest that it is not necessarily optimum to have a tab height ratio near ⅓ but rather somewhere intermediate zero and ⅓. This is perhaps because, though the reduced stresses in the tab appear to be at their lowest near a height ratio of ⅓ or more, the elevated stresses near the arcuate portions of the tab are also at or near peak values. A tab height ratio somewhat shy of ⅓ should still create reduced stresses within the tab, while the elevated stresses in the tab arcuate portions should not be as high. As a practical matter, perhaps tab height ratios between about one tenth and one third (10 and 33 percent) represent the best range for optimum performance in general, though this range may vary depending on the particular tab geometry and bag film, and certainly values outside this range in some cases may still be effective.

Generally, the installation stresses in a neckdown bag with a tab may be highest at the increased stress regions in and near the arcuate portions of the tab. Fortunately, these areas of increased stress occur conveniently away from the central portion of the tab region and away from the reduced stress region caused by the tab in the portion of the bag adjacent the tab. As installation forces are increased in a bag for example, the areas generally in and near fillets having high stress ratios may eventually yield locally on increasing applied load, thus conveniently further isolating to some extent the areas of generally low stress ratio created by the tab. Because the regions of increased stress ratio occur in distinct, localized, and isolated areas, it is possible to avoid passing a seam through these regions yet still be able to terminate the seam in the low stress regions inside or near a tab. In particular, at least for a symmetric tab, the increased stress regions occur conveniently displaced from the line of symmetry of the tab. Thus, for example, a seam portion of a bag can be safely passed through the regions of reduced stress on or near the centerline of the tab, (i.e. the seam passes between the increased stress areas) and the seam can safely terminate anywhere within, or at a free edge of, the tab.

1.6 Summary of Analytic Study

The results of the study suggest that a tab will advantageously modify the installation and service stresses that develop in the mouth portion of a bag at and adjacent the tab. A seam can be passed safely through or terminate in the reduced stress regions created by the tab, thereby diminishing the chances that a tear will occur at or near the portions of a seam lying in the reduced stress region. Since in a neckdown bag elevated service stresses tend to occur around the mouth portion of the bag, especially where a seam intersects or terminates at the mouth edge, a tab can be positioned to create reduced stresses at or near where the seam intersects the mouth edge. A tab so positioned that the seam passes through the reduced stress regions created by the tab may greatly reduce or eliminate the possibility of tearing of the bag, and especially a seam portion thereof, in the neighborhood of the tab.

Judicious sizing (in an absolute sense) of a tab will depend on many factors. Certainly a tab should be of a size to create a sufficiently large reduced stress zone into which to safely pass and terminate a seam. As a practical matter, for most seams of the kind discussed herein, i.e. those formed by a heat or fused seal, an adhesive bond, and a creased unfolded joinder, the effective width of the stressed portion of the seam may be quite narrow, perhaps on the order of no more than 1/16 inch. Then a tab would be needed having a width of at least this, and perhaps more, to allow the seam to clear the arcuate fillet regions. A tab having a width perhaps in the range from about 1/8 to 4 inches may be adequate in most cases, though it is conceivable that this range may be exceeded in either direction in some cases.

The above results, though derived from studies of only three tab styles, are believed to lend some insight into tab function. Regardless of the particular tab geometry, certain basic tab characteristics appear to be key to a tab's ability to advantageously modify service stresses in a bag film as described. These include that the tab comprise a finlike cantilever extension of a portion of the bag adjacent the mouth edge wherein the tab integrally adjoins the bag at the base of the tab, and the mouth edge portions of the tab are free edges. A tab satisfying these basic requirements should create a zone of modified stresses both in the tab, and in portions of the bag adjacent the tab similar to those described. Since at least a portion of a seam portion extends across the tab base into the tab, in some tab embodiments a portion of a tab may comprise "flashing", that is, essentially unstressed excess edge portions of the bag resulting from certain heat or fused seal, or adhesive bond, seam constructions previously described hereinabove. Since the flashing portion of a tab may not necessarily contribute to the tab function (indeed the idealized analytic FEM models used in the study presented herein ignored such elements), the "finlike" description refers in these cases, primarily to the non-flashing portions of such a tab embodiment. Specifically, when determining the tab height ratio for a particular tab geometry, the tab width measurement used in the determination should not include any unstressed "flashing" portions of the tab base. Although the term "finlike" may connote a tapering down in width of the tab from the tab base, it is apparent that the tab width need only taper near the tab base between the reentrant arcuate portions of the mouth edge defining the tab base. The tab need not necessarily taper in nor taper out thereafter. For example, for the 1/4, 3/8, and 1/2 inch high rectangular tab models the tab width did not taper but rather was a constant 1/2 inch beyond the fillet portions of the free edge of the tab.

Figure 20A:
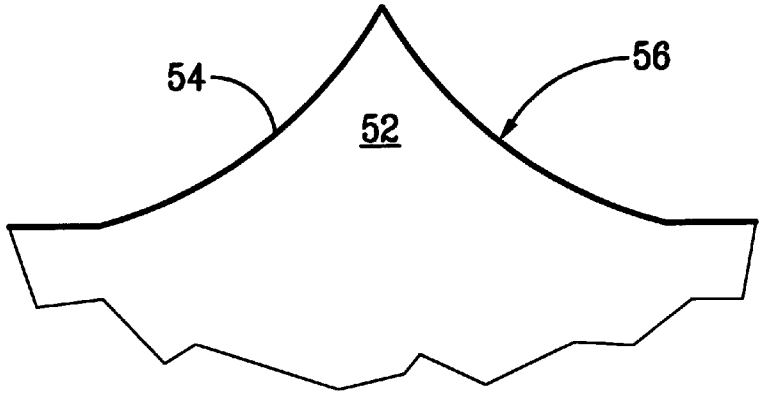
FIGS. 20A and 20B are plan views of tabs showing examples of cusp and ogive tab styles, respectively.
Figure 20B:
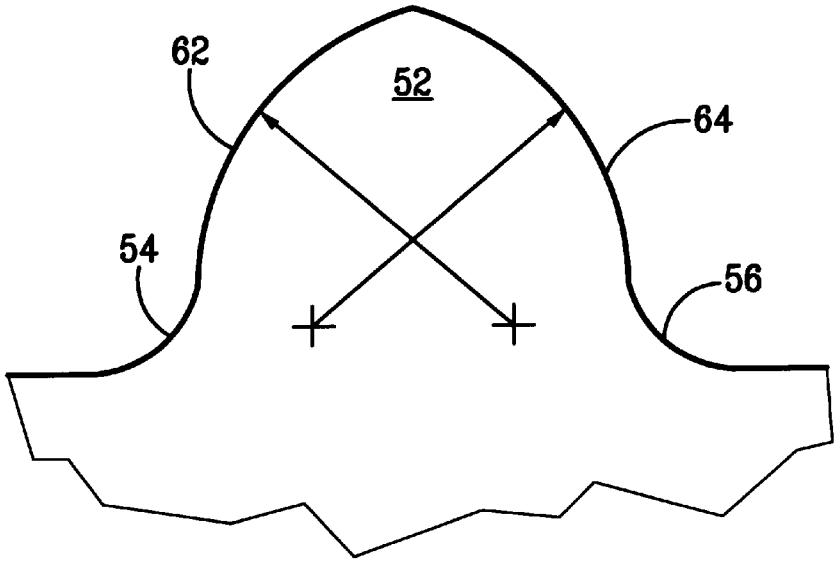

Though the analytic study used specific absolute sizes for dimensions of a modeled tab, this should not presume to limit the applicability of the results only to tabs having the size and even the shape or style of those investigated. For example, a tab style not investigated here, but one of relatively simple construction, termed a "cusp" style, is depicted in FIG. 20A of the drawings. In the cusp style tab the first and second mouth edge portions of the tab comprise, respectively, only the first and second reentrant arcuate portions defining the tab base. Another relatively straightforward tab style not investigated is the ogive style, depicted in FIG. 20B, which generally comprises a pointed arch shape. Many other tab styles and shapes not investigated here are also possible.

EXAMPLE OF TRIAL TESTS OF PLASTIC FLAT NECKDOWN BAGS

Tests were conducted with pleated neckdown waste bags made of a plastic polyethylene film. Pleated neckdown waste bags, having a flat construction as described in the flat bag embodiment, were tested as waste bin liners in residential kitchen service. The bags used in the test had either one or two pleat portions at the top portion of the bag. The means for interconnecting the flanks of each pleat portion was a heat seal partway across the top portion of the bag.

The test bags were made of various low density polyethylene films, such as a 0.85 mil Linear Low Density Polyethylene (LLDPE) from a commercially available kitchen bag. The body portion of all test bags, when in the flat, or unexpanded state, had a nominal width, measured perpendicular to the length of the bag, of approximately 24 inches which corresponded nominally to a 48 inch first inside circumference, C1. A circular waste bin was used in all the tests as the supporting receptacle for the bags. The bin had a 24.5 inch diameter rim (the outermost diameter of the lip), corresponding to a circumference of 45.5 inches (i.e. the body portions of the bags were about 5 to 6 percent larger in circumference than the lip of the waste bin used). With the abovementioned bag and bin dimensions, it is clear that for a bag of the size used and having a mouth to body circumference ratio (C2/C1) of about 95 percent, the circumference of the mouth portion of the bag would be about equal that of the rim of the waste bin. Then for a bag having a mouth to body circumference ratio (C2/C1) of about 95 percent or less, kinematic interference of the bag mouth with the rim of the waste bin would theoretically occur on attempting to fit the bag over the rim of the waste bin. It was found in these tests that good retention of the bag mouth to the supporting bin was achieved with mouth to body circumference ratios (C2/C1) in the range of about 50 to 92 percent. More or less optimum results, in terms of providing good retention of the mouth portion of the bag to the supporting bin, while requiring only moderate stretching of the bag in order to install the bag, were obtained with bags having a mouth to body circumference ratio (C2/C1) of about 70 percent. In some cases, for bags without tabs, tearing occurred at one or both of the top seam portions of the bags. The tearing typically started at the point where a top seam portion intersected the mouth portion, and propagated outwardly along the seam toward the pleat edge. Even so, bags with partial tears were still able to remain engaged with the bin throughout the service lives of the bags.

Several of the tests were conducted with flat tabbed neckdown bags, each tab having a generally rectangular tab style. The tab widths were in the range from about ½ to 1 inches, and the tab heights in the range from about ⅕ to ¾ inches. The tab height ratios were in the range from about 50 to 100 percent. Each tab was positioned so as to protect a heat sealed top seam portion from tearing in the neighborhood of the tab. In other words, the inwardmost end of a top seam portion terminated at the free edge of a tab in the manner hereinabove described. Each tabbed test bag was constructed by modifying a commercially available 13 gallon plastic waste liner made of 0.85 mil LLDPE bag film. Ten flat bags with tabs were tested, and five of these ten bags also possessed a series of tear arresting "slits" made transverse to each top seam and serially spaced along the top seam between the tab and the corresponding pleat edge (each of the slits were in a manner similar to that taught by Gruentzel et. al. in U.S. Pat. No. 3,485,437). Each of the tabbed bags had a mouth to body circumference ratio (C2/C1) in the range from approximately 67 to 71 percent. Of the ten tabbed bags subjected to residential kitchen service, no bag experienced tearing of any seam during the installation and service life of the waste bag.

The above presented results, data, and specific dimensions for actual kitchen tests of actual neckdown bags are intended merely as examples of pleated neckdown bags and of tab embodiments and plastic bag film, and are not intended to define limitations on the present invention.

SUMMARY AND SCOPE

While the foregoing detailed description contains many specificities, these are to be taken as merely illustrative of some of the preferred embodiments of the invention. For example, while specific styles for a tab, such as rectangular, triangular and circular, etc. have been disclosed, many other general tab shapes are possible including symmetric or even asymmetric shapes. As further examples, a pleated neckdown bag may be constructed of a film made of a plastic film other than one of those specifically described herein. Further, the deformation response of a plastic film of which a bag is constructed need not match that of any presented herein. Accordingly, it is understood that variations and modifications in the construction, form, and arrangement of one or more elements of the invention are possible without departing from the spirit and scope of the invention.

I claim:

1. A combination consisting of a supporting collection receptacle and a generally tubular pleated neckdown bag of a flexible plastic film having a thickness of between 0.2 and 4 mils inserted therein, said neckdown bag comprising:

a top portion;

a hollow body portion having a first inside circumference thereof;

wherein said top portion is disposed adjacent said hollow body portion and thereadjoins generally about the first inside circumference thereof, said hollow body portion thereby extending generally downwardly from said top portion, said top portion of said neckdown bag further comprising at least one pleat portion thereof;

at least one top seam portion thereof having an outwardmost end thereof and having an inwardmost end thereof;

at least one mouth portion thereof having a second inside circumference;

wherein said pleat portion lies adjacent said mouth portion and is pleated inwardly thereto, wherein said pleat portion comprises a first flank portion;

a second flank portion;

a pleat edge portion;

said second flank portion adjoining said first flank portion generally upwardly and downwardly along said pleat edge portion, whereby said pleat edge portion faces generally outwardly away from said mouth portion, said top seam portion further comprising means for interconnecting said first and second flank portions of said pleat portion across at least a portion of said top portion of said neckdown bag; whereby said inwardmost end of said top seam portion is disposed adjacent said mouth portion and said outwardmost end of said top seam portion is spaced further outwardly away from said open mouth portion than said inwardmost end, whereby said inwardmost end of said top seam portion restricts at least said mouth portion so that said second inside circumference thereof is less than said first inside circumference of said body portion, whereby said mouth portion of said liner is fitted over a supporting receptacle whereby said top portion of said neckdown bag more securely engages with said supporting receptacle and said mouth portion is more securely held in an open state;

the neckdown bag further including at least one tab, wherein said mouth portion of said neckdown bag further comprises:

a mouth edge;

said mouth edge further comprising at least a first mouth edge portion thereof and a second mouth edge portion thereof;

said first mouth edge portion and said second mouth edge portion each extending from said inwardmost end of said top seam portion generally away from said top seam portion, said first mouth edge portion further comprising at least a first reentrant arcuate portion;

and said second mouth edge portion further comprising at least a second reentrant arcuate portion;

said first and second reentrant arcuate portions defining a tab base therebetween wherein said top seam portion extends across said tab base, whereby said tab is a cantilever extension of a portion of said neckdown bag adjacent said mouth edge, said tab projecting from said tab base between said first and second reentrant arcuate portions of said mouth edge.

2. The combination of claim 1 wherein said first inside circumference and said second inside circumference define a mouth to body circumference ratio in the range from about 50 to 95 percent, and wherein said tab has a tab width and tab height, said tab width and tab height further defining a tab height ratio, and wherein said tab width is in the range from about 0.125 to 4 inches, and said tab height ratio is in the range from about 10 to 100 percent.

3. The combination of claim 2 wherein said tab has a tab style selected from the group consisting of rectangular, triangular, circular, ogive, and cusp.

4. The combination of claim 1 wherein said liner has a flat construction wherein said liner has at most two pleat portions thereof and has at least one unexpanded state wherein said neckdown bag further comprises a first panel portion;

a second panel portion, wherein said first panel portion overlies said second panel portion when said neckdown bag is in said unexpanded state, and wherein said first and second panel portions are approximately equal circumferential half portions of said neckdown bag, and wherein said first flank portion of said pleat portion of said neckdown bag is a portion of said first panel portion, and said second flank portion of said pleat portion is a portion of said second panel portion, and wherein said first mouth edge portion is a portion of said first panel portion of said neckdown bag, and said second mouth edge portion is a portion of said second panel portion of said neckdown bag, whereby said top seam portion interconnects said first and second panel portions of said neckdown bag across at least a portion of said top portion of said neckdown bag, and whereby said first and second panel portions are substantially flat and substantially unstressed when said neckdown bag is in said unexpanded state.

5. The combination of claim 4 wherein said tab has a tab width and tab height, said tab width and tab height further defining a tab height ratio, and wherein said tab width is in the range from about 0.125 to 4 inches, and said tab height ratio is in the range from about 10 to 100 percent.

6. The combination of claim 4 wherein said first inside circumference and said second inside circumference define a mouth to body circumference ratio in the range from about 50 to 95 percent, and wherein said tab has a tab width and tab height, said tab width and tab height further defining a tab height ratio, and wherein said tab width is in the range from about 0.125 to 4 inches, and said tab height ratio is in the range from about 10 to 100 percent.

7. The combination of claim 6 wherein said flexible plastic film is made of a plastic selected from the group consisting of an ethylene plastic and a blend that includes an ethylene plastic.

8. The combination of claim 7 wherein said tab has a tab style selected from the group consisting of rectangular, triangular, circular, cusp, and ogive.

9. A combination consisting of a supporting collection receptacle and a generally tubular pleated neckdown bag of a flexible plastic film having a thickness of between 0.2 and 4 mils inserted therein, said neckdown bag comprising:

a top portion;

a hollow body portion having a first inside circumference thereof, wherein said top portion is disposed adjacent said hollow body portion and thereadjoins generally about the first inside circumference thereof, said hollow body portion thereby extending generally downwardly from said top portion, said top portion of said neckdown bag further comprising at least one pleat portion thereof;

at least one top seam portion thereof having an outwardmost end thereof and having an inwardmost end thereof;

at least one mouth portion thereof having a second inside circumference;

wherein said pleat portion lies adjacent said mouth portion and is pleated inwardly thereto, wherein said pleat portion comprises a first flank portion;

a second flank portion;

a pleat edge portion;

said second flank portion adjoining said first flank portion generally upwardly and downwardly along said pleat edge portion, whereby said pleat edge portion faces generally outwardly away from said mouth portion, said top seam portion further comprising means for interconnecting said first and second flank portions of said pleat portion across at least a portion of said top portion of said neckdown bag; whereby said inwardmost end of said top seam portion is disposed adjacent said mouth portion and said outwardmost end of said top seam portion is spaced further outwardly away from said open mouth portion than said inwardmost end, whereby said inwardmost end of said top seam portion restricts at least said mouth portion so that said second inside circumference thereof is less than said first inside circumference of said body portion, whereby said mouth portion of said liner is fitted over a supporting receptacle whereby said top portion of said neckdown bag more securely engages with said supporting receptacle and said mouth portion is more securely held in an open state; wherein said liner has a flat construction wherein said liner has at most two pleat portions thereof and has at least one unexpanded state wherein said neckdown bag further comprises a first panel portion;

a second panel portion;

wherein said first panel portion overlies said second panel portion when said neckdown bag is in said unexpanded state, and wherein said first and second panel portions are approximately equal circumferential half portions of said neckdown bag, and wherein said first flank portion of said pleat portion of said neckdown bag is a portion of said first panel portion, and said second flank portion of said pleat portion is a portion of said second panel portion, whereby said top seam portion interconnects said first and second panel portions of said neckdown bag across at least a portion of said top portion of said neckdown bag, and whereby said first and second panel portions are substantially flat and substantially unstressed when said neckdown bag is in said unexpanded state.

10. The combination of claim 9 wherein said first inside circumference and said second inside circumference define a mouth to body circumference ratio in the range from about 50 to 95 percent.

11. The combination of claim 10 wherein said flexible plastic film is made of a plastic selected from the group consisting of an ethylene plastic and a blend that includes an ethylene plastic.

12. A combination of (1) a supporting collection receptacle having at least one side and an upper rim and (2) a generally tubular pleated neckdown bag of a flexible plastic filn having a thickness of between 0.2 and 4 mils fitted over the upper rim of the receptacle, said neckdown bag comprising:

a top portion;

a hollow body portion having a first inside circumference thereof;

wherein said top portion is disposed adjacent said hollow body portion and thereadjoins generally about the first inside circumference thereof, said hollow body portion thereby extending generally downwardly from said top portion, said top portion of said neckdown bag further comprising at least one pleat portion thereof;

at least one top seam portion thereof having an outwardmost end thereof and having an inwardmost end thereof;

at least one mouth portion thereof having a second inside circumference;

wherein said pleat portion lies adjacent said mouth portion and is pleated inwardly thereto, wherein said pleat portion comprises a first flank portion;

a second flank portion;

a pleat edge portion;

said second flank portion adjoining said first flank portion generally upwardly and downwardly along said pleat edge portion, whereby said pleat edge portion faces generally outwardly away from said mouth portion, said top seam portion further comprising means for interconnecting said first and second flank portions of said pleat portion across at least a portion of said top portion of said neckdown bag;

whereby said inwardmost end of said top seam portion is disposed adjacent said mouth portion and said outwardmost end of said top seam portion is spaced further outwardly away from said open mouth portion than said inwardmost end, whereby said inwardmost end of said top seam portion restricts at least said mouth portion so that said second inside circumference thereof is less than said first inside circumference of said body portion, whereby said mouth portion of said liner is fitted over the upper rim of the supporting receptacle whereby said top portion of said neckdown bag more securely engages with the upper rim of the supporting receptacle and said mouth portion is more securely held in an open state; wherein the neckdown bag further includes at least one tab, wherein said mouth portion of said neckdown bag further comprises:

a mouth edge;

said mouth edge further comprising at least a first mouth edge portion thereof and a second mouth edge portion thereof;

said first mouth edge portion and said second mouth edge portion each extending from said inwardmost end of said top seam portion generally away from said top seam portion, said first mouth edge portion further comprising at least a first reentrant arcuate portion;

and said second mouth edge portion further comprising at least a second reentrant arcuate portion;

said first and second reentrant arcuate portions defining a tab base therebetween wherein said top seam portion extends across said tab base, whereby said tab is a cantilever extension of a portion of said neckdown bag adjacent said mouth edge, said tab projecting from said tab base between said first and second reentrant arcuate portions of said mouth edge.

13. The combination of claim 12 wherein said first inside circumference and said second inside circumference define a mouth to body circumference ratio in the range from about 50 to 95 percent, and wherein said tab has a tab width and tab height, said tab width and tab height further defining a tab height ratio, and wherein said tab width is in the range from about 0.125 to 4 inches, and said tab height ratio is in the range from about 10 to 100 percent.

14. The combination of claim 13 wherein said tab has a tab style selected from the group consisting of rectangular, triangular, circular, ogive, and cusp.

15. The combination of claim 12 wherein said liner has a flat construction wherein said liner has at most two pleat portions thereof and has at least one unexpanded state wherein said neckdown bag further comprises a first panel portion;

a second panel portion;

wherein said first panel portion overlies said second panel portion when said neckdown bag is in said unexpanded state, and wherein said first and second panel portions are approximately equal circumferential half portions of said neckdown bag, and wherein said first flank portion of said pleat portion of said neckdown bag is a portion of said first panel portion, and said second flank portion of said pleat portion is a portion of said second panel portion, and wherein said first mouth edge portion is a portion of said first panel portion of said neckdown bag, and said second mouth edge portion is a portion of said second panel portion of said neckdown bag, whereby said top seam portion interconnects said first and second panel portions of said neckdown bag across at least a portion of said top portion of said neckdown bag, and whereby said first and second panel portions are substantially flat and substantially unstressed when said neckdown bag is in said unexpanded state.

16. The combination of claim 15 wherein said tab has a tab width and tab height, said tab width and tab height further defining a tab height ratio, and wherein said tab width is in the range from about 0.125 to 4 inches, and said tab height ratio is in the range from about 10 to 100 percent.

17. The combination of claim 15 wherein said first inside circumference and said second inside circumference define a mouth to body circumference ratio in the range from about 50 to 95 percent, and wherein said tab has a tab width and tab height, said tab width and tab height further defining a tab height ratio, and wherein said tab width is in the range from about 0.125 to 4 inches, and said tab height ratio is in the range from about 10 to 100 percent.

18. The combination of claim 17 wherin said flexible plastic film is made of a plastic selected from the group consisting of an ethylene plastic and a blend that includes an ethylene plastic.

19. The combination of claim 18 wherein said tab has a tab style selected from the group consisting of rectangular, triangular, circular, cusp, and ogive.

20. A combination of (1) a supporting collection receptacle having at least one side and an upper rim and (2) a generally tubular pleated neckdown bag of a flexible plastic film having a thickness of between 0.2 and 4 mils fitted over the upper rim of the receptacle, said neckdown bag comprising:

a top portion;

a hollow body portion having a first inside circumference thereof;

wherein said top portion is disposed adjacent said hollow body portion and thereadjoins generally about the first inside circumference thereof, said hollow body portion thereby extending generally downwardly from said top portion, said top portion of said neckdown bag further comprising at least one pleat portion thereof;

at least one top seam portion thereof having an outwardmost end thereof and having an inwardmost end thereof;

at least one mouth portion thereof having a second inside circumference;

wherein said pleat portion lies adjacent said mouth portion and is pleated inwardly thereto, wherein said pleat portion comprises a first flank portion;

a second flank portion;

a pleat edge portion;

said second flank portion adjoining said first flank portion generally upwardly and downwardly along said pleat edge portion, whereby said pleat edge portion faces generally outwardly away from said mouth portion, said top seam portion further comprising means for interconnecting said first and second flank portions of said pleat portion across at least a portion of said top portion of said neckdown bag;

whereby said inwardmost end of said top seam portion is disposed adjacent said mouth portion and said outwardmost end of said top seam portion is spaced further outwardly away from said open mouth portion than said inwardmost end, whereby said inwardmost end of said top seam portion restricts at least said mouth portion so that said second inside circumference thereof is less than said first inside circumference of said body portion, whereby said mouth portion of said liner is fitted over the upper rim of the supporting receptacle whereby said top portion of said neckdown bag more securely engages with the upper rim of the supporting receptacle and said mouth portion is more securely held in an open state; wherein said liner has a flat construction wherein said liner has at most two pleat portions thereof and has at least one unexpanded state wherein said neckdown bag further comprises a first panel portion;

a second panel portion;

wherein said first panel portion overlies said second panel portion when said neckdown bag is in said unexpanded state, and wherein said first and second panel portions are approximately equal circumferential half portions of said neckdown bag, and wherein said first flank portion of said pleat portion of said neckdown bag is a portion of said first panel portion, and said second flank portion of said pleat portion is a portion of said second panel portion, whereby said top seam portion interconnects said first and second panel portions of said neckdown bag across at least a portion of said top portion of said neckdown bag, and whereby said first and second panel portions are substantially flat and substantially unstressed when said neckdown bag is in said unexpanded state.

21. The combination of claim 20 wherein said first inside circumference and said second inside circumference define a mouth to body circumference ratio in the range from about 50 to 95 percent.

22. The combination of claim 21 wherein said flexible plastic film is made of a plastic selected from the group consisting of an ethylene plastic and a blend that includes an ethylene plastic.

* * * * *

UNITED STATES PATENT AND TRADEMARK OFFICE

CERTIFICATE OF CORRECTION

PATENT NO. : 6,220,753 B1
DATED : April 24, 2001
INVENTOR(S) : Metzger

It is certified that error appears in the above-identified patent and that said Letters Patent is hereby corrected as shown below:

Column 4,
Line 66, "teat" should be -- tear --.

Column 7,
Line 9, -- 42 Second Panel Portion -- should appear below "40" and above "44".
Line 33, "ractangular" should be -- rectangular --.

Column 11,
Line 31, "outwardinost" should be -- outwardmost --.
Line 37, "fised" should be -- fused --.
Line 52, "spint" should be -- spirit --.

Column 12,
Line 28, "unfolded" should be -- u-folded --.
Line 59, "flaf" should be -- flat --.

Column 16,
Line 9, "filsed" should be -- fused --.
Line 18, "unfolded" should be -- u-folded --.

Column 21,
Line 35, "unfolded" should be -- u-folded --.

Claim 25,
Line 11, thereof, "," after "second panel portion" should be -- ; --.

UNITED STATES PATENT AND TRADEMARK OFFICE

CERTIFICATE OF CORRECTION

PATENT NO. : 6,220,753 B1
DATED : April 24, 2001
INVENTOR(S) : Metzger

It is certified that error appears in the above-identified patent and that said Letters Patent is hereby corrected as shown below:

Claim 27,
Line 2, thereof, "filn" should be -- film --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*